US009260240B2

(12) United States Patent
Bradford et al.

(10) Patent No.: US 9,260,240 B2
(45) **Date of Patent: *Feb. 16, 2016**

(54) CONTAINER HAVING SLIDING SUPPORT ASSEMBLIES FOR SUPPORTING DUNNAGE

(71) Applicant: Bradford Company, Holland, MI (US)

(72) Inventors: Judson A. Bradford, Holland, MI (US); Allen L. Burns, Holland, MI (US)

(73) Assignee: Bradford Company, Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/669,396

(22) Filed: Mar. 26, 2015

(65) Prior Publication Data

US 2015/0232265 A1 Aug. 20, 2015

Related U.S. Application Data

(63) Continuation of application No. 13/781,886, filed on Mar. 1, 2013, now Pat. No. 9,016,507, which is a continuation-in-part of application No. 13/225,835, filed on Sep. 6, 2011, now Pat. No. 9,120,597.

(51) Int. Cl.

| | |
|---|---|
| ***B42F 17/02*** | (2006.01) |
| ***B65D 25/10*** | (2006.01) |
| ***B65D 81/05*** | (2006.01) |
| ***B65D 81/07*** | (2006.01) |
| ***B65D 6/00*** | (2006.01) |
| ***B65D 8/14*** | (2006.01) |
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 73/00*** | (2006.01) |
| ***B65D 85/00*** | (2006.01) |
| ***B65D 88/54*** | (2006.01) |
| ***B65D 90/12*** | (2006.01) |

(52) U.S. Cl.
CPC ..... *B65D 88/546* (2013.01); *B65D 90/12* (2013.01)

(58) Field of Classification Search
CPC ..... B42F 15/00035; B42F 15/00094; B42F 17/02; B65D 25/10; B65D 2519/0082; B65D 81/05; B65D 81/07
USPC ..... 220/544, 6, 529, 530; 206/485, 461
See application file for complete search history.

(56) References Cited

U.S. PATENT DOCUMENTS

| | | | |
|---|---|---|---|
| 634,589 | A | 10/1899 | Russell |
| 1,712,168 | A | 5/1929 | Rand, Jr. |

(Continued)

FOREIGN PATENT DOCUMENTS

| | | |
|---|---|---|
| DE | 19549166 | 3/1997 |
| DE | 20101374 | 4/2001 |

(Continued)

*Primary Examiner* — Fenn Mathew
*Assistant Examiner* — Andrew T Kirsch
(74) *Attorney, Agent, or Firm* — Wood, Herron & Evans, LLP

(57) ABSTRACT

A container for holding product therein during shipment and being returned for reuse has a body, track assemblies attached to opposite sides of the body, and a plurality of support assemblies extending between the track assemblies. Outer members of the support assemblies have notches which enable the support assemblies to slide along the track assemblies to move parts supported by dunnage suspended by the support assemblies.

20 Claims, 18 Drawing Sheets

(56) References Cited

U.S. PATENT DOCUMENTS

| | | | |
|---|---|---|---|
| 3,093,140 | A | 6/1963 | Guichard |
| 4,527,694 | A | 7/1985 | Bolt et al. |
| 4,685,571 | A | 8/1987 | Hoss |
| 4,721,317 | A | 1/1988 | Avot |
| 4,770,314 | A | 9/1988 | Giesler |
| 4,821,879 | A | 4/1989 | Kupersmit |
| 4,864,686 | A | 9/1989 | Lasier et al. |
| 4,988,006 | A | 1/1991 | Lundin |
| 5,238,139 | A | 8/1993 | Bisceglia |
| 5,324,105 | A | 6/1994 | Christensen |
| 5,407,262 | A | 4/1995 | Christian et al. |
| 5,560,507 | A | 10/1996 | Arpin et al. |
| 5,725,119 | A | 3/1998 | Bradford et al. |
| 5,813,566 | A | 9/1998 | Bradford et al. |
| 5,815,903 | A | 10/1998 | Foster et al. |
| 6,062,410 | A | 5/2000 | Bradford et al. |
| 6,164,440 | A | 12/2000 | Van Bree |
| 6,202,884 | B1 | 3/2001 | Verkerke |
| 6,230,916 | B1 | 5/2001 | Bradford et al. |
| 6,352,157 | B1 | 3/2002 | Srinivasan |
| 6,540,096 | B1 | 4/2003 | Bazany et al. |
| 6,830,156 | B2 | 12/2004 | MacKelvie |
| 7,125,062 | B2 | 10/2006 | Kiester et al. |
| 7,748,559 | B2 | 7/2010 | Bradford |
| 7,762,422 | B2 | 7/2010 | Dobrinski |
| 8,100,282 | B2 | 1/2012 | Nyeboer et al. |
| 9,016,507 | B2 * | 4/2015 | Bradford ..... B65D 19/06 206/461 |

FOREIGN PATENT DOCUMENTS

| | | |
|---|---|---|
| FR | 1455414 | 4/1966 |
| FR | 2860504 | 4/2005 |
| JP | 6-59230 | 8/1994 |

* cited by examiner

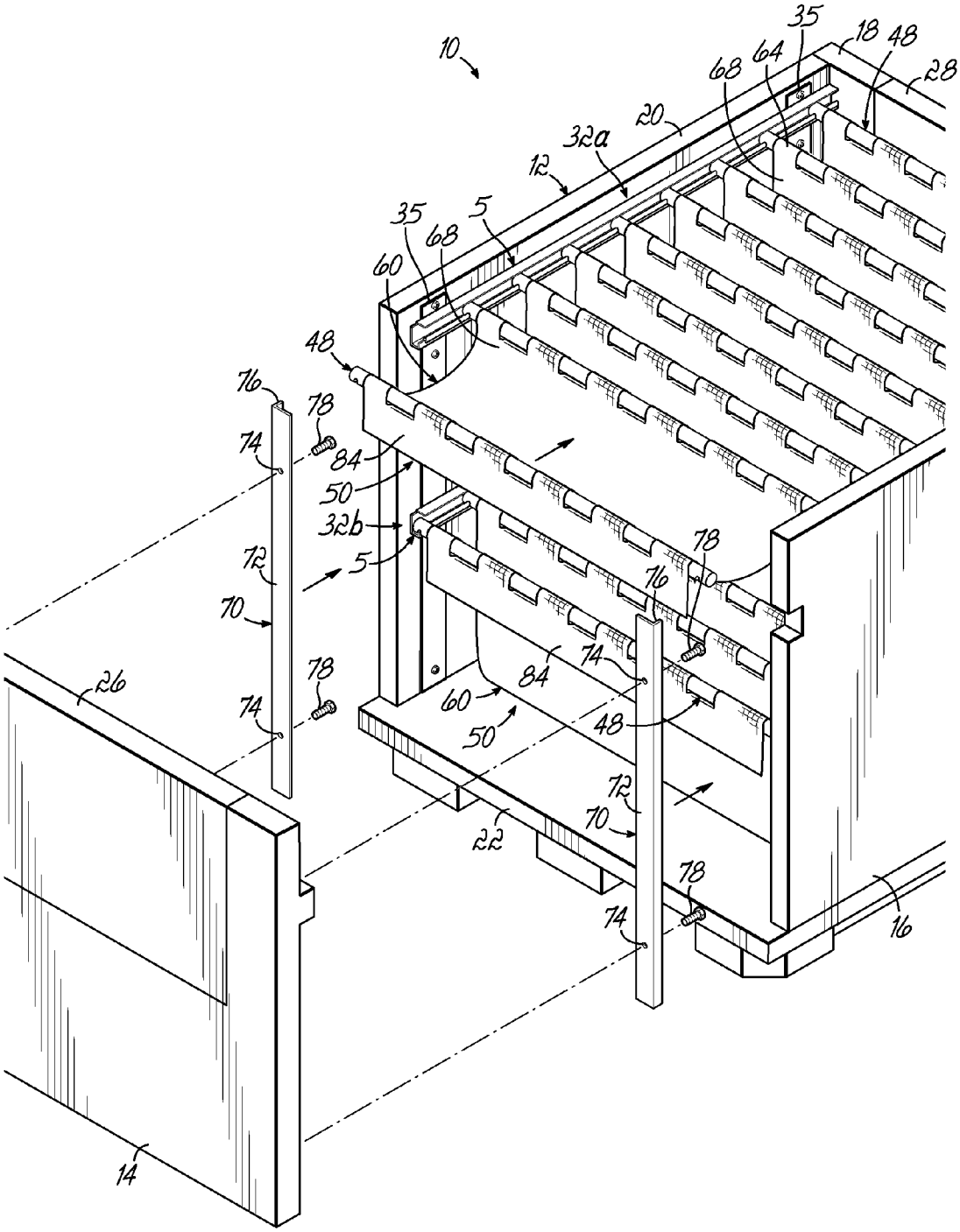
10
35
18
48
28
68
64
20
32a
12
5
35
68
60
48
16
78
74
84
50
32b
5
72
70
78
26
74
84
60
50
48
78
16
74
72
70
22
78
74
16
14

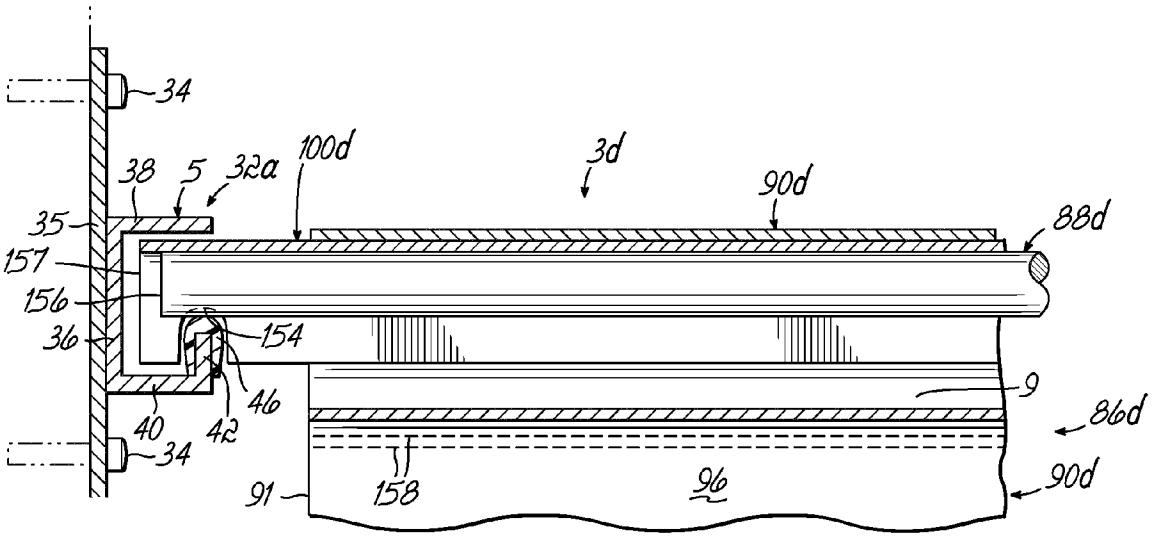
FIG. 18
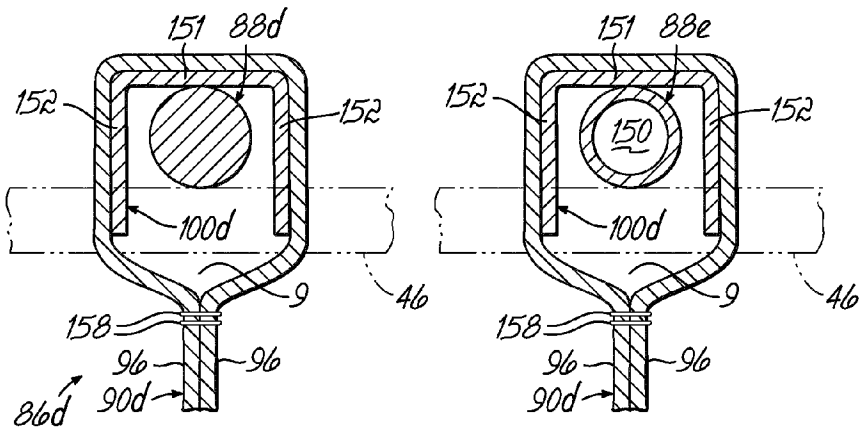
FIG. 19
FIG. 19A
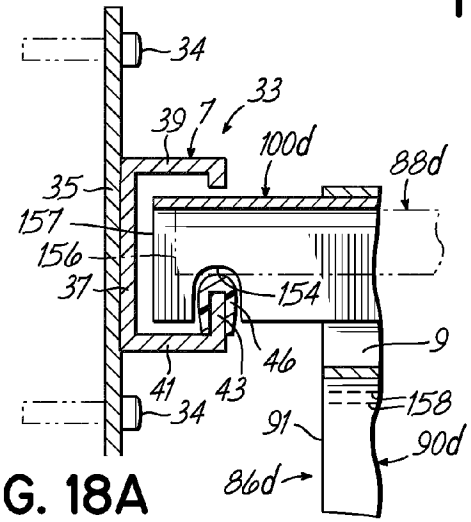
FIG. 18A

CONTAINER HAVING SLIDING SUPPORT ASSEMBLIES FOR SUPPORTING DUNNAGE

CROSS-REFERENCE TO RELATED APPLICATIONS

This application is a continuation of U.S. patent application Ser. No. 13/781,886 filed Mar. 1, 2013, now U.S. Pat. No. 9,016,507, a continuation-in-part of U.S. patent application Ser. No. 13/225,835 filed Sep. 6, 2011, now U.S. Pat. No. 9,120,597 each of which is fully incorporated by reference herein.

FIELD OF THE INVENTION

The present invention relates to containers for use in shipping and, more particularly, to containers with movable members for supporting product.

BACKGROUND OF THE INVENTION

A large number of different container structures are utilized by manufacturers to ship a variety of different products to end users, which may be, for example, assembly plants. In the automobile industry, for example, an assembly plant assembling a particular automobile might utilize a number of different parts from different manufacturers. These manufacturers ship their respective parts to the assembly plant in container structures where the parts are then removed from dunnage or support members inside the container structure and assembled into a finished automobile.

Access to the product in the containers is of particular concern. Specifically, in the automotive industry, the containers full of product are positioned on an assembly line adjacent to a work area which is associated with a particular product to be installed on a manufactured vehicle. For example, a container full of interior door panels is usually positioned next to a particular station on an assembly line where interior door panels are installed so that a line worker may easily access the door panels inside the container. The product or part is taken directly from the container and used on the line. Some existing containers are difficult to access, which makes removal of the parts therein difficult and time consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In many containers, a line worker or employee must insert or remove parts from a distal or rear part of the container. The size and/or weight of the parts or work pieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In containers having multiple layers or level of parts, a line worker or employee must lean forward and bend down into the container to insert or remove a part or work piece from the bottom of the container. This movement by the line worker is ergonomically unfriendly because the line worker must lean forward and bend down into the container to insert or remove a part or work piece from the bottom of the container. This movement is necessary with many top loading containers.

Depending upon the number of times the line worker repeats this unnatural motion, strain in the back, legs and arms may result. The size and/or weight of the parts or work pieces may increase the strain on the line worker. Thus, simply removing multiple parts during a work day may cause physical trauma, pain and other injuries that may lead to lost production time.

In known containers having multiple levels or layers of dunnage, such as pouches, a pocket may be sewn at the upper edges of each side of each pouch and sized to receive a rod or support member. The support member may have rollers or end members secured to opposed ends of the support member. The rollers or end members roll or move in tracks secured to the sides of the container. Such sewing adds to the cost of the pouch or dunnage and, therefore, to the cost of the container. The rollers or end members add additional cost to the assembled container and present an opportunity for failure due to fatigue/wear.

Accordingly, there is a need for a container which has one or more layers of movable dunnage therein which may be assembled with limited portions of the dunnage being sewn.

There is further a need for a container which has movable dunnage therein which may be assembled without the need for rollers.

SUMMARY OF THE INVENTION

The present invention provides a container for holding product therein during shipment that has a body having a bottom and at least two sides. The container further comprises track assemblies supported by the body at different vertical levels. The container further comprises a plurality of support assemblies generally inside the container. Each of the support assemblies comprises an inner member and an outer member at least partially surrounding the inner member. The inner members may be solid or tubular and made of any desired material. The outer member has notches engaged with and slidable along the track assemblies. The inner and outer members of the support assemblies may be any desired shape. The inner and outer members may be approximately the same length or different lengths. They may assume other shapes or configurations other than those shown in the embodiments shown or described.

The container further comprises dunnage supported by the support assemblies. The dunnage may comprise pouches or any other known form of dunnage. The dunnage may be suspended from the support assemblies in any known manner. For example, an upper portion of each side of a dunnage pouch may have a receptacle sewn therein in which resides one of the support assemblies. Alternatively, the dunnage and, more particularly, the sides of the pouches, may be slotted so as to allow support assemblies to be woven through the slots in the dunnage without the need for sewing, although sewing may be utilized in specific areas of the pouch.

According to another aspect of the invention, the container for holding product therein during shipment may have a body having a bottom and at least two side structures. The container may further comprise multiple levels of track assemblies secured to opposed side structures of the body. The container may further comprise a plurality of support assemblies extending between and supported by the track assemblies. At least some of the support assemblies may comprise inner and outer members, the outer members having notches at opposed ends thereof. The notches of the outer members and the inner members may be engaged with and slidable along the track assemblies. The inner members of the support assemblies may be metallic rods, but may assume other cross-sectional configurations. The outer members of the support assemblies may assume an inverted U-shape in cross-section, but may assume other cross-sectional configurations. The container further comprises dunnage supported by the support assemblies. The dunnage may comprise pouches or any other known form of dunnage. The dunnage may be suspended from the support assemblies in any desired known manner.

According to another aspect of the invention, the container for holding product therein during shipment may have a body having a bottom and at least two side structures. The container may further comprise track assemblies supported by the side structures at different vertically spaced levels. The container may further comprise a plurality of support assemblies extending between opposed track assemblies at the same vertical level. Each of the support assemblies may comprise an inner rod and an outer member having a pair of notches. Each of the support assemblies may be engaged with and slidable along the tracks. The container may further comprise dunnage supported by the support assemblies. The dunnage may comprise pouches or any other known form of dunnage. The dunnage may be suspended from the support member assemblies in any known manner.

Support assemblies made as described herein may have a width less than known support assemblies or members, thereby enabling a larger number of support assemblies and thus, more pouches to be used in a row in the container. The more support assemblies within a row of the container, the more products that may be stored and shipped in that row. In one embodiment, the inner member of each support assembly is trapped inside the outer member made of polyvinylchloride ("PVC") and slides along the nylon track sliders on opposite sides of the container. In one embodiment, the overall width of each support assembly may be one-half inch, the inner member or rod having a diameter of ⅜ inch.

The above and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

FIG. 5 is a partially disassembled perspective view of the container of FIG. 1;

FIG. 18 is a cross-sectional view taken along the line 18-18 of FIG. 17;

FIG. 18A is a view like FIG. 18 showing a track of a slightly different configuration;

FIG. 19 is a cross-sectional view taken along the line 19-19 of FIG. 17; and FIG. 19A is a view like FIG. 19 showing an inner member of a support assembly being tubular.

DETAILED DESCRIPTION OF THE INVENTION

Figure 1:
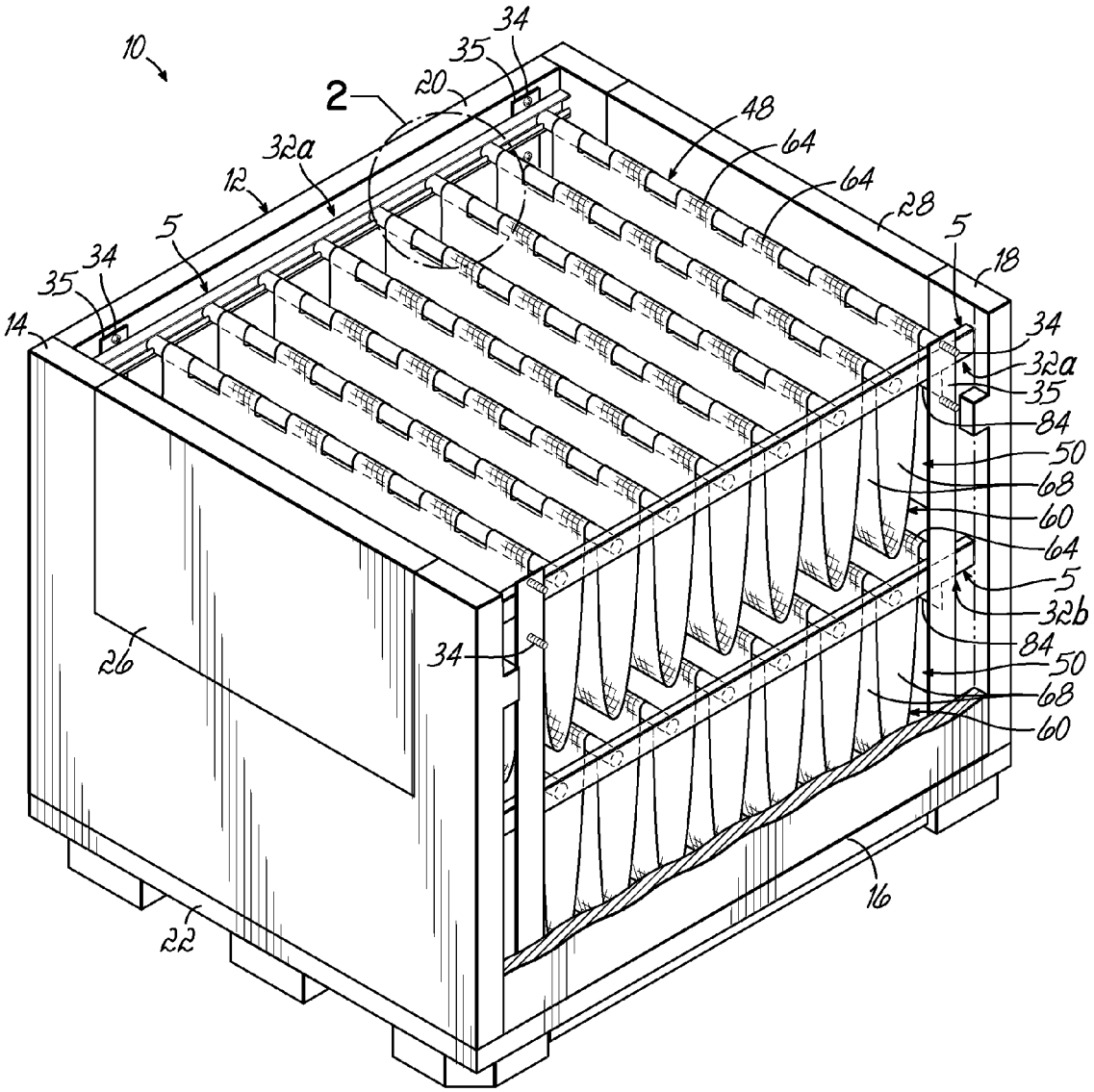
FIG. 1 is a perspective view of a portion of one embodiment of a reusable and returnable container showing two layers of tracks, support members and associated dunnage in the form of pouches.
Figure 15:
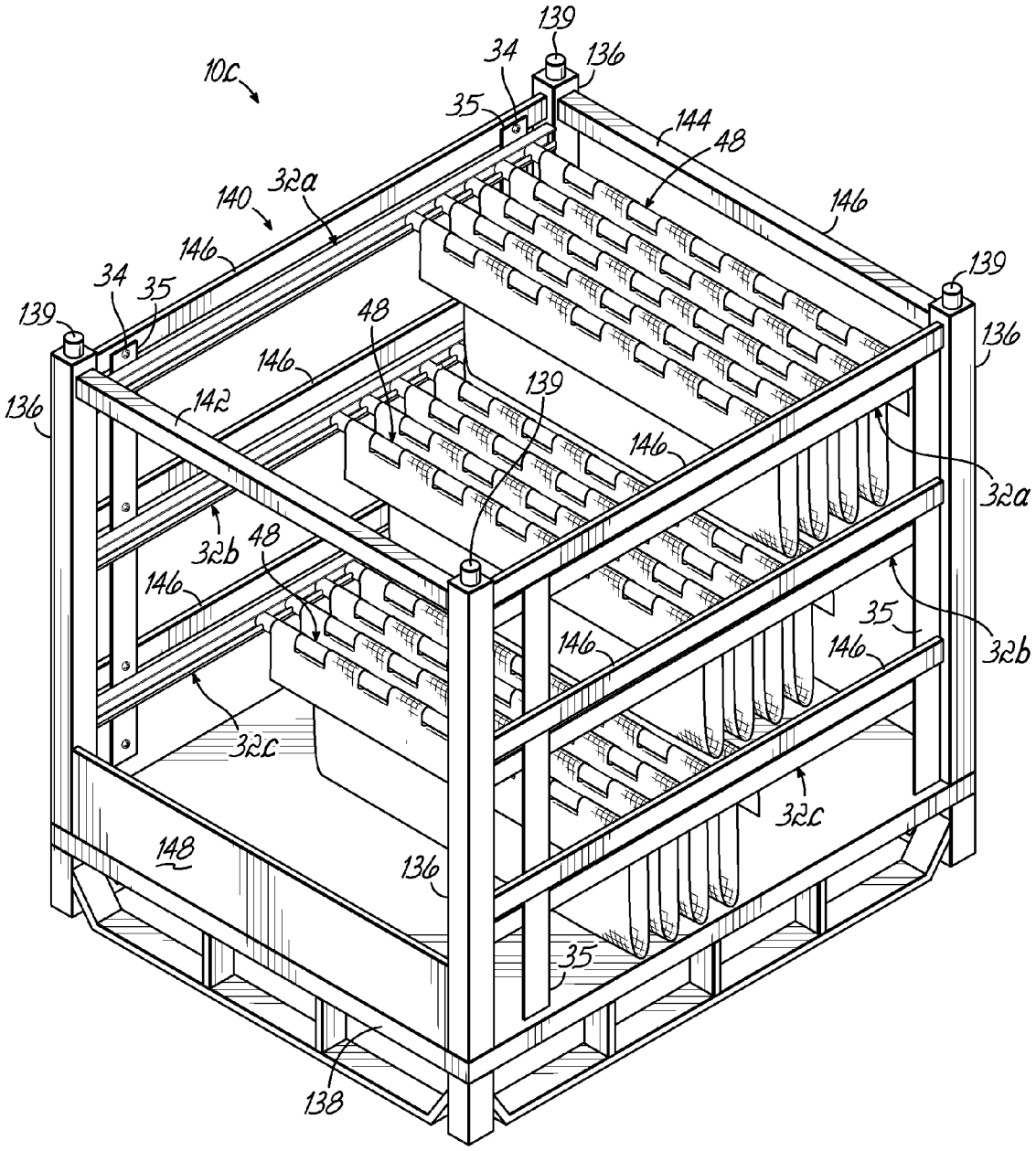
FIG. 15 is a perspective view of an alternative embodiment of a reusable and returnable container having three levels or layers of tracks, support members and associated dunnage in the form of pouches.

Referring to FIG. 1, there is illustrated a reusable and returnable container 10. The container 10 comprises a body 12 having a front 14, a side 16 (partially broken away), a rear 18 and another side 20, all extending upwardly from a base or bottom 22. Although one type of container is illustrated, the present invention may be used with any type or configuration of container. For example, the present invention may be used in a container in which one or more of the sides of the container are hinged for the container to be more easily erected and/or compacted for storage. As shown in FIG. 15, the container may also be a rack type of container which has four corner posts extending upwardly from a base. For purposes of this document, any of the structures 14, 16, 18 or 20 may be considered side structures or sides or walls or wall structures.

A cover (not shown) may also be included to enclose the container 10 and further protect and secure product 24 (shown in phantom in FIGS. 8A, 8B and 8C) during shipment. Although one configuration of product 24 is illustrated and described herein, the present invention may be used to store and ship other configurations of product not shown or described. This document is not intended to limit the type of product being shipped or stored.

As shown in FIGS. 1, 5, 8A, 8B and 8C, front wall or side structure 14 and the rear wall or side structure 18 of container 10 each has a drop down door 26, 28, respectively. Each door 26, 28 is hinged to the remainder of the wall or side structure 14, 18, respectively using hinges 30 (see FIGS. 8A, 8B and 8C). Each door 26, 28 may be locked in a closed or upright position shown in FIG. 1 or dropped into an open position shown in FIGS. 8A and 8B to facilitate loading or unloading product 24 from the container 10. One type of container (without dunnage or tracks or track assemblies) which has such lockable doors is available from the Orbis Corporation of Oconomowoc, Wis.

Figure 2:
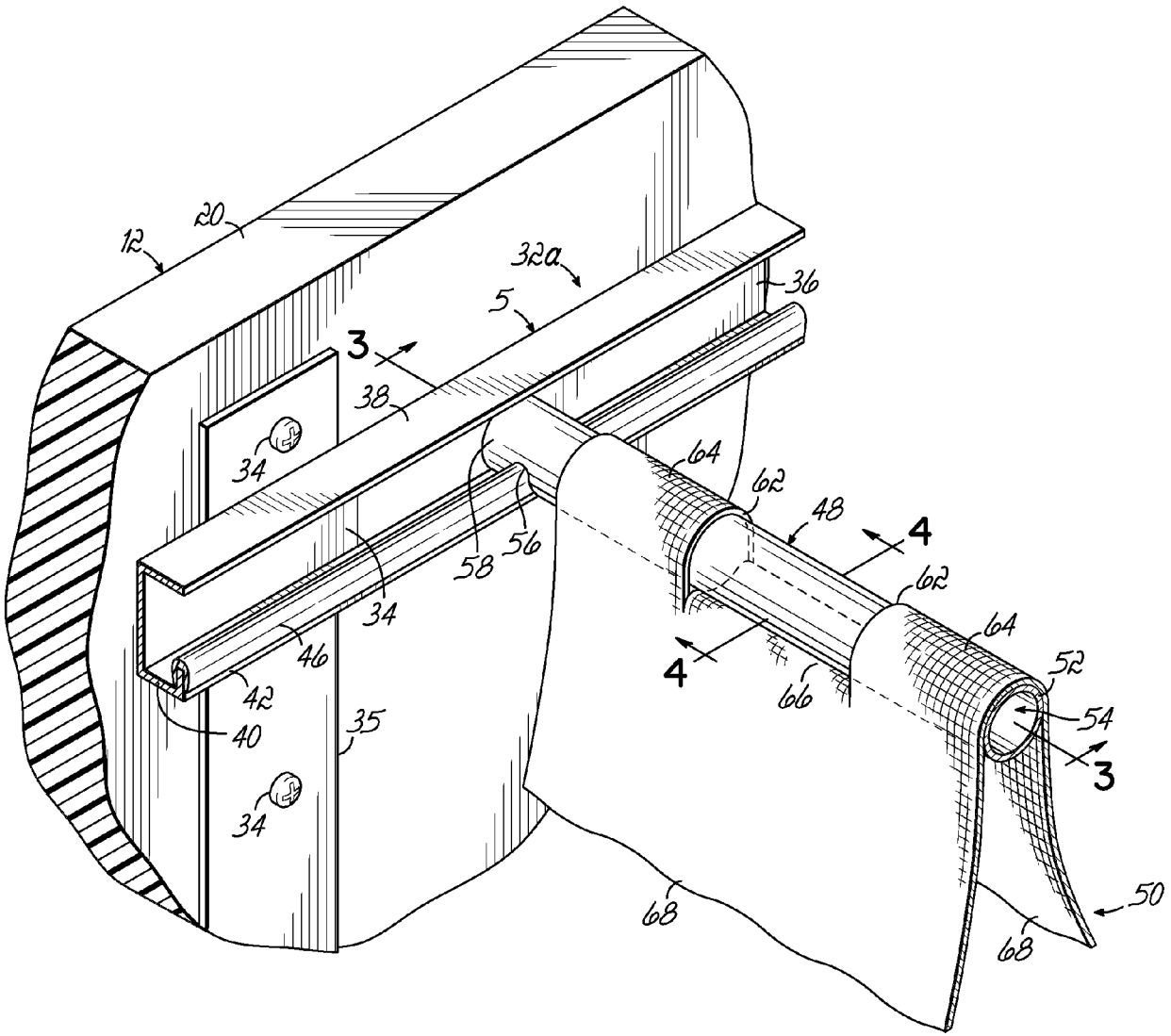
FIG. 2 is a perspective view of the encircled area 2 of FIG. 1.

The container 10 further comprises a plurality of track assemblies 32*a*, 32*b* arranged in pairs. The track assemblies 32*a*, 32*b* are welded or otherwise secured to braces 35 which are secured to the body 12 and, more particularly, to opposed sides or side structures 16, 20 of the body 12 via fasteners 34, as best shown in FIG. 2. However, the track assemblies 32*a*, 32*b* may be secured directly to the container body 12 in any known manner without the use of braces. In either case, the container body 12 supports the track assemblies 32*a*, 32*b*, either directly or indirectly. Although two braces 35 are shown per side, any number of braces may be used of any desired size.

FIG. 1 shows container 10 having two levels or vertically spaced layers of track assemblies 32*a*, 32*b*. However, this document is not intended to limit the number of levels or layers of track assemblies of any of the embodiments shown or described herein. An upper pair of track assemblies 32*a* is welded or otherwise secured to braces 35 secured to opposed sides or side structures 16, 20 of the body 12 at the same vertical level or height inside the container 10. Similarly, a lower pair of track assemblies 32*b* is welded or otherwise secured to braces 35 secured to opposed sides or side structures 16, 20 of the body 12 at the same vertical level or height inside the container 10 below upper track assemblies 32*a*.

Figure 2A:
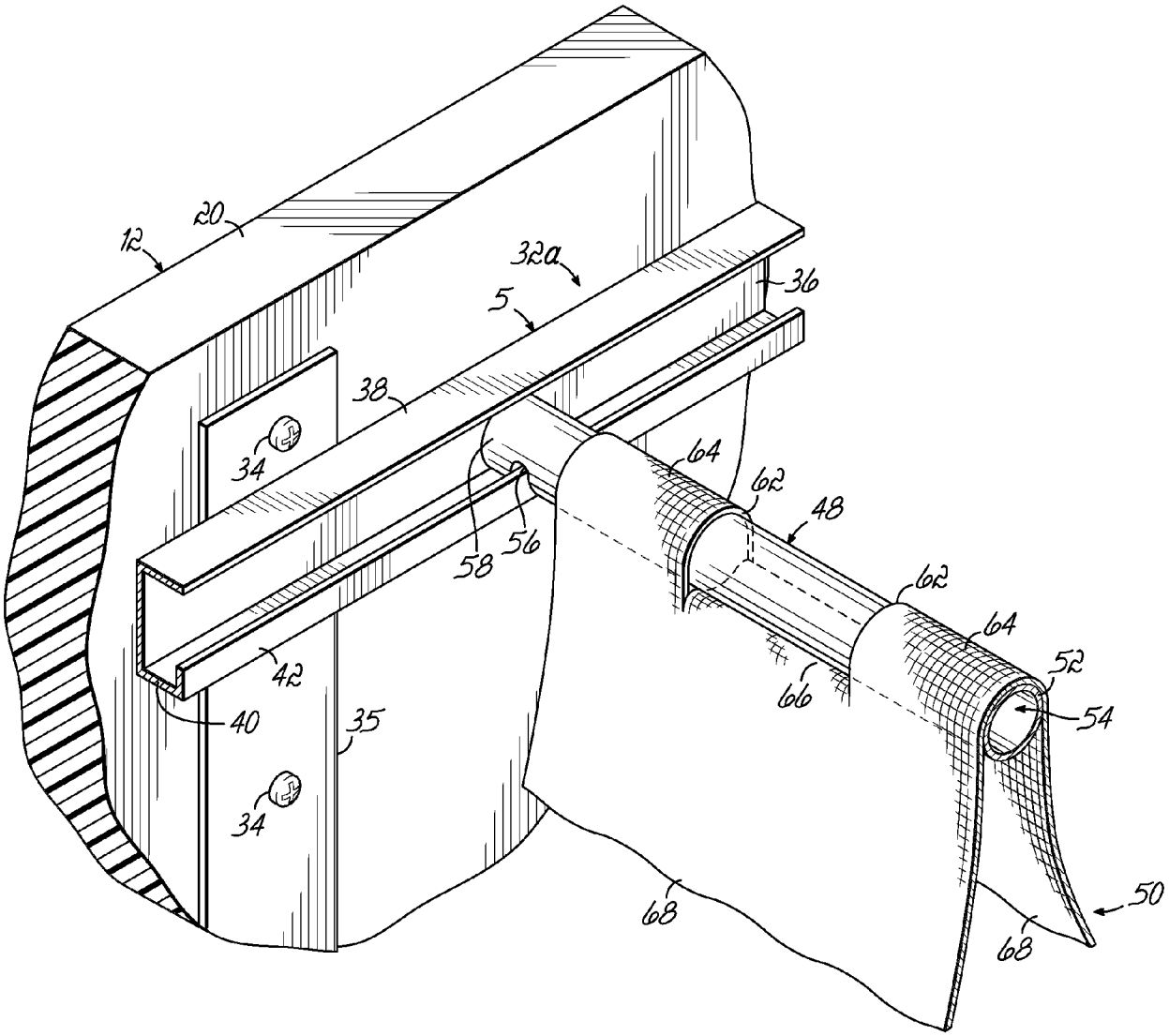
FIG. 2A is a perspective view like FIG. 2, but showing an alternative embodiment.
Figure 3:
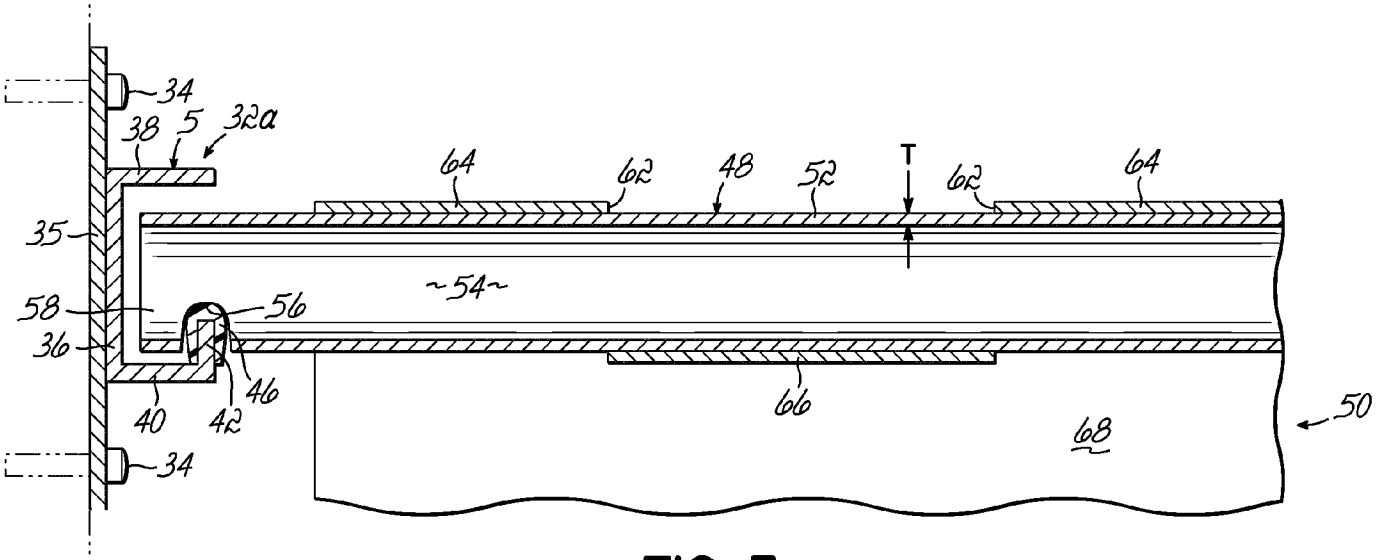
FIG. 3 is a cross-sectional view taken along the line 3-3 of FIG. 2.
Figure 4:
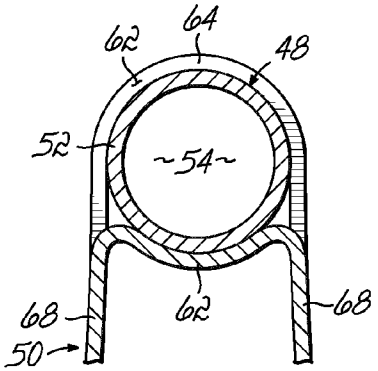
FIG. 4 is a cross-sectional view taken along the line 4-4 of FIG. 2.

As shown in FIGS. 2 and 3, each track assembly 32*a*, 32*b* comprises a generally C-shaped track 5 and a track slider 46. The track 5 includes a back 36, an upper wall 38 and a lower wall 40 each extending outwardly from the back 36. The track 5 further comprises a lower lip 42 extending upwardly from the inner edge of the lower wall 40. As best shown in FIGS. 2, 2A, 5 and 7, each track 5 has a front edge 80 and a cut-out 82 removed from the upper wall 38.

Figure 3A:
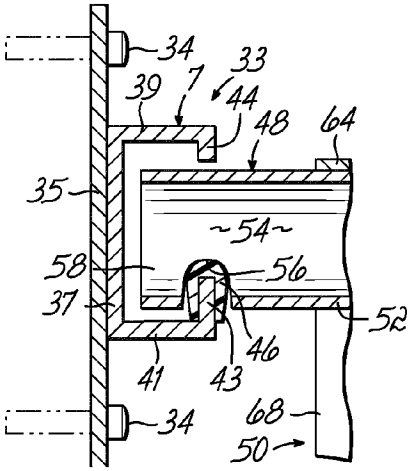
FIG. 3A is a view like FIG. 3 showing a track of a slightly different configuration.

FIG. 3A illustrates an alternative configuration of track assembly 33 comprising a generally C-shaped track 7 and a track slider 46. The track 7 has a back 37, an upper wall 39 and a lower wall 41, each extending outwardly from the back 37. The track 7 further comprises a lower lip 43 extending upwardly from the inner edge of the lower wall 41 and an upper lip 44 extending downwardly from the inner edge of the upper wall 39. Although FIGS. 1 and 2 illustrate track assemblies 32*a*, 32*b*, the container 10 may alternatively be equipped with track assemblies 33, as shown in FIG. 3A. In any of the containers shown or described herein, the track assemblies may be like track assemblies 32*a*, 32*b* shown in FIGS. 1-3, or like track assembly 33 shown in FIG. 3A or any combination thereof.

FIGS. 2 and 3 illustrate a track slider 46 having an inverted U-shape placed over the lower lip 42 of one of the tracks 5. Although FIGS. 2 and 3 illustrate only one track slider 46, each track 5 of the container 10 of FIG. 1 preferably has a track slider 46 covering the lower lip of the track 5 to facilitate movement of the support members 48. The track slider 46 is preferably made of nylon, but may be made of any plastic material which has a relatively low coefficient of friction. FIG. 3A illustrates a track slider 46 over the lower lip 43 of track 7. A track slider 46 may extend the full length of the track 5, 7 or alternatively less than the full length of the track. The track slider 46 facilitates movement of the support members 48 from front to back or back to front inside the container. The presence of the track sliders 46 along the lower lips of the tracks 5, 7 makes moving the support members 48 at any level easier for an operator and thus, may reduce the time necessary to load or unload a container.

As shown in FIG. 2A, if desired, track sliders 46 may be omitted. In such a situation, the support members 48 would directly contact the tracks 5 or 7 and slide or move along the tracks 5, 7 from front to rear inside the container. In any of the embodiments described or shown herein, the braces 35 and fasteners 34 used to secure the braces 35 to the sides or body of the container may be considered part of a track assembly.

FIG. 1 illustrates two levels of support members 48, each support member 48 being a unitary member and extending between a pair of track assemblies 32*a*, 32*b* at the same level or height. The track assemblies 32*a*, 32*b* or 33 support the weight of the support members 48 and associated dunnage 50, as described below. FIGS. 2 and 3 illustrate a portion of one of the support members 48. Support members or cross members 48 may be made of metal or plastic, such as polyvinylchloride, known as PVC. As shown in FIG. 3, each support member 48 has a wall 52 of a thickness "T" and a hollow interior 54. As best shown in FIGS. 2 and 3, each support member 48 at each end has a notch or cut-out 56 located in an end portion 58 (only one being shown). The notch 56 rests on top of one of the track sliders 46 (or tracks 32*a* as shown in FIG. 2A) and slides thereon. The notch 56 is sized to reside on and engage one of the track sliders 46 or tracks 5, 7. See FIGS. 2, 2A and 3. A portion of the end portion 58 of each support member 48 resides inside the interior of one of the tracks 5, 7 and moves therein upon movement of the support member 48. Each notch or cut-out may be any desired configuration and is not intended to be limited by the drawings of this document. Similarly, the location and number of notches or cut-outs of each support member is not intended to be limited by the drawings of this document.

The dunnage 50 of each level or layer may comprise one or more pieces of dunnage material. In one embodiment, one piece of dunnage material is used for one level or layer of dunnage 50. However, multiple pieces of material may be used in one or more levels or layers of dunnage. The material may be a textile material, such as polyester. However, this document is not intended to limit the material of the dunnage.

The drawings show the dunnage 50 supported by the support members 48 being in the form of pouches 60, each level having its own level of pouches. Two adjacent support members 48 support a pouch 60. Each level of pouches 60 may be made from one piece of material or multiple pieces of material. As best shown in FIG. 2, the dunnage 50 or pouches 60 at each level may be supported by the support members 48 without the need for any sewing or welding. The elimination or reduction of sewing or welding reduces the cost of assembly and therefore, reduces the price of a container equipped with dunnage and ready to use.

As best shown in FIGS. 1 and 2, at each level, the dunnage material has a plurality of spaced cuts 62 (only one pair being shown in FIG. 2) which enable one of the support members 48 to be threaded through the dunnage material. As shown in FIG. 3, the result of such a process of securing the dunnage material to one of the support members 48 is that portions 64 of the dunnage material reside above the support member 48, and other portions 66 of the dunnage material reside above the support member 48. The dunnage 50 is thereby secured to the support member 48 without any material being removed from the dunnage and without the need for sewing or bonding or welding the dunnage to itself to form a receiver for the support member. Two sides 68 of the piece of dunnage material extend downwardly from each of the support members 48 and form part of the pouches 60. As shown in FIGS. 5, 8A, 8B and 8C, the dunnage material of each level or layer has a pair of loose end portions 84 which hang downwardly and are not attached to any structure.

Figure 2B:
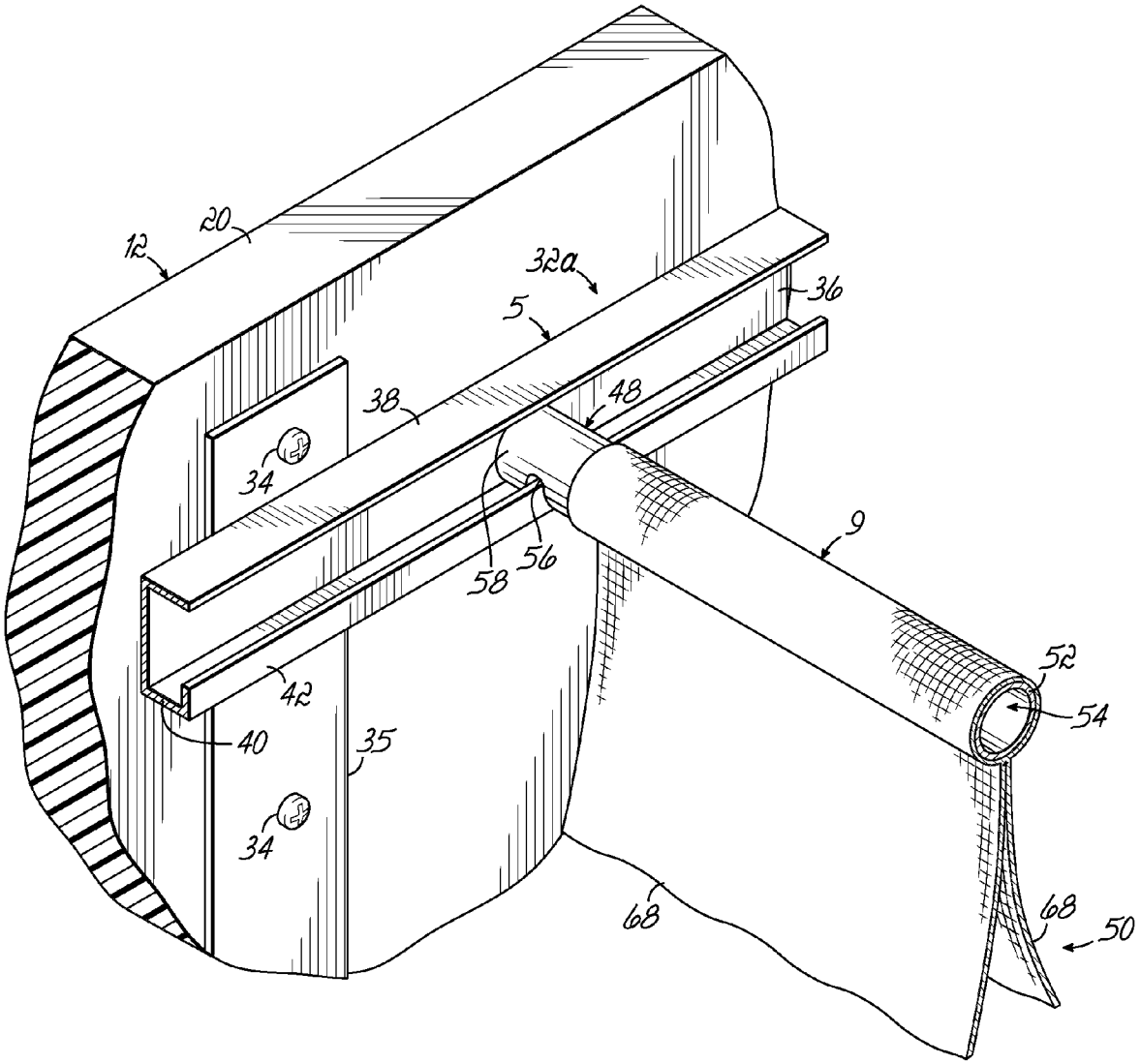
FIG. 2B is a perspective view like FIG. 2, but showing an alternative embodiment.

As shown in FIG. 2B, if desired, the dunnage material may be secured to itself via sewing or welding, as is known, to create a receiver 9. One of the support members 48 (which is not known) passes through receiver 9. In such a situation, the support members 48 would directly contact the track sliders 46 (or tracks 5 or 7) and slide or move along them from front to rear inside the container, as in the embodiment shown in FIGS. 1-3. Dunnage having receivers 9 may be used in any embodiment shown or described herein.

Figure 6:
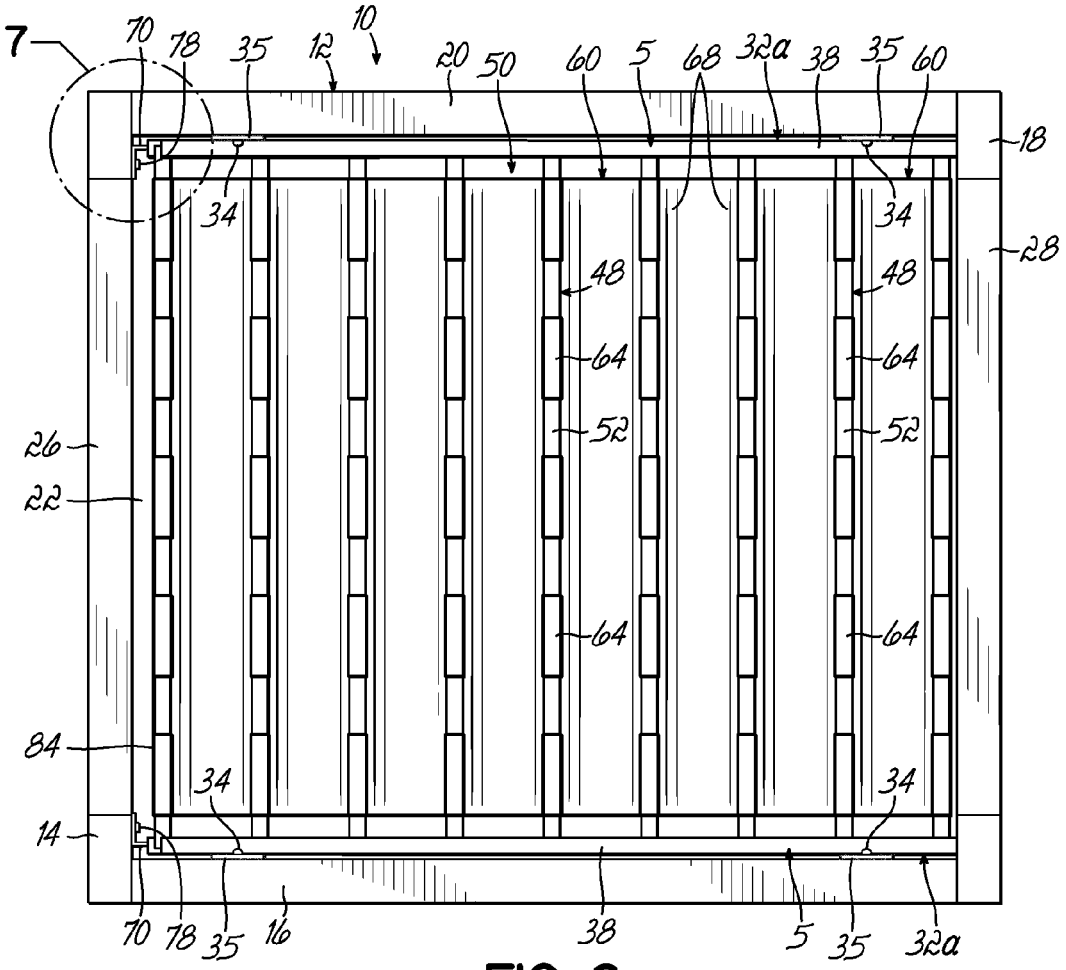
FIG. 6 is a top view of the container of FIG. 1.
Figure 7:
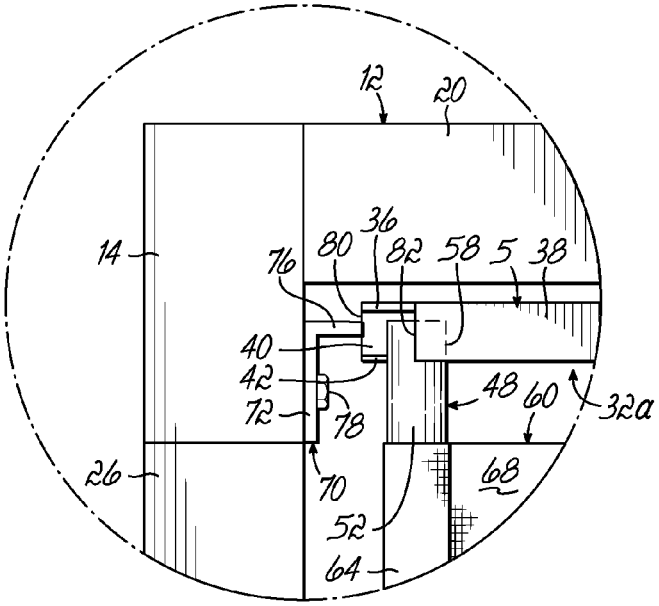
FIG. 7 is a perspective view of the encircled area 7 of FIG. 6.

FIG. 5 shows the container 10 partially disassembled. After all of the support members 48 and associated dunnage in the form of pouches 60 are placed inside the container with the end portions 58 of the support members 48 being inside the tracks 32*a*, 32*b*, a pair of holders 70 are secured with fasteners 78 to the inside of front wall 14. Each holder 70 is generally a bracket having an "L-shaped" cross-sectional configuration comprising a wall 72 with holes 74 through the wall 72 and another wall 76 extending perpendicular to the wall 72. The holes 74 are sized so that fasteners 78 may pass therethrough to secure each holder 70 to the front 14 of container 10. The wall 76 is shorter than the wall 72 of each holder 70 and sized so that it contacts or comes close to contacting the front edges 80 of tracks 5. See FIGS. 6 and 7. The purpose of the holders 70 is to prevent the support members 48 from disengaging from the track assemblies 32*a*, 32*b* or falling out of the track assemblies 32*a*, 32*b*. In other words, the holders 70 in a fully assembled container 10 keep the support members 48 at their proper level and prevent them from falling downwardly.

Figure 8A:
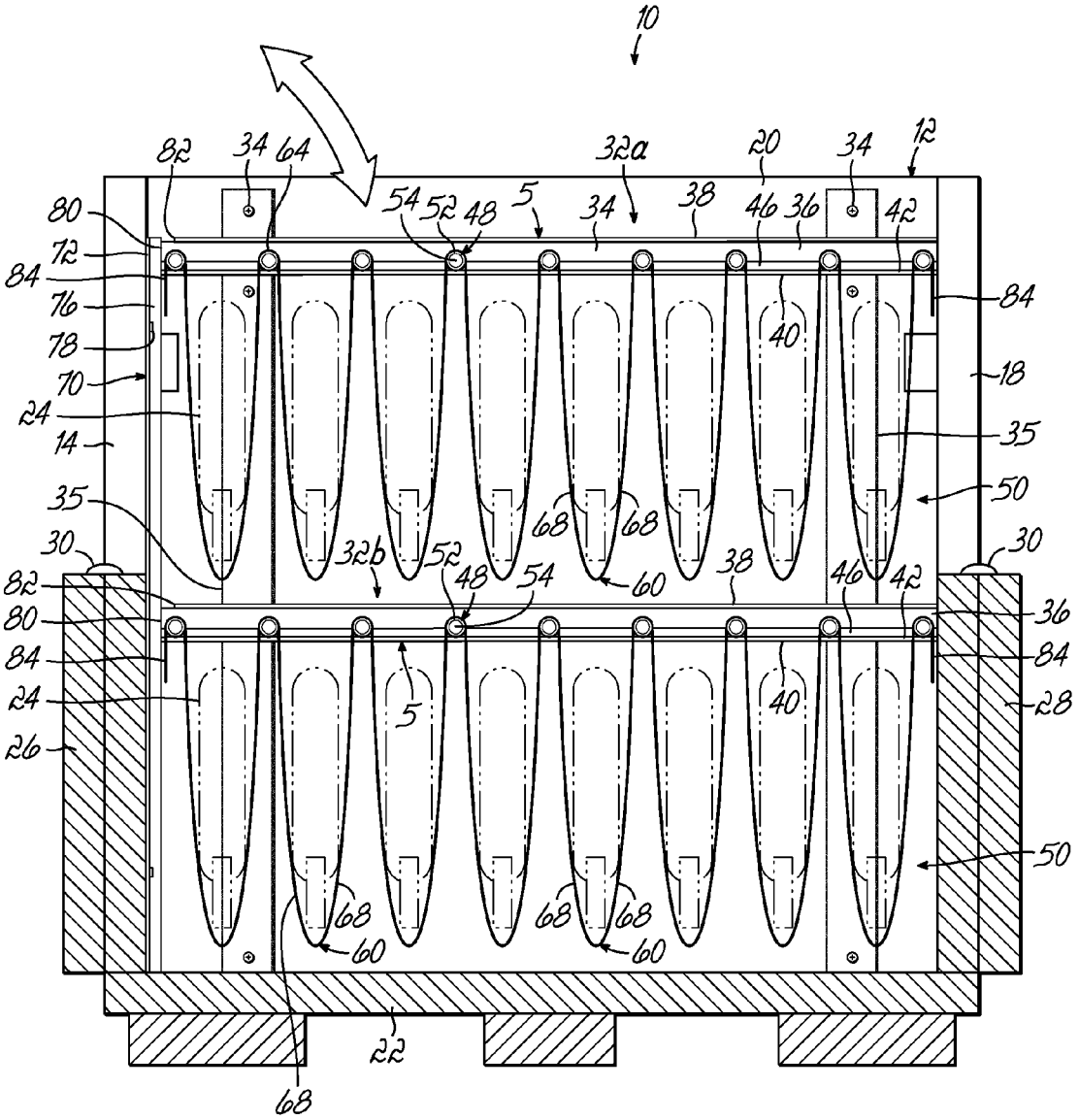
FIG. 8A is a side elevational view of the container of FIG. 1 loaded with product shown in dashed lines.
Figure 8B:
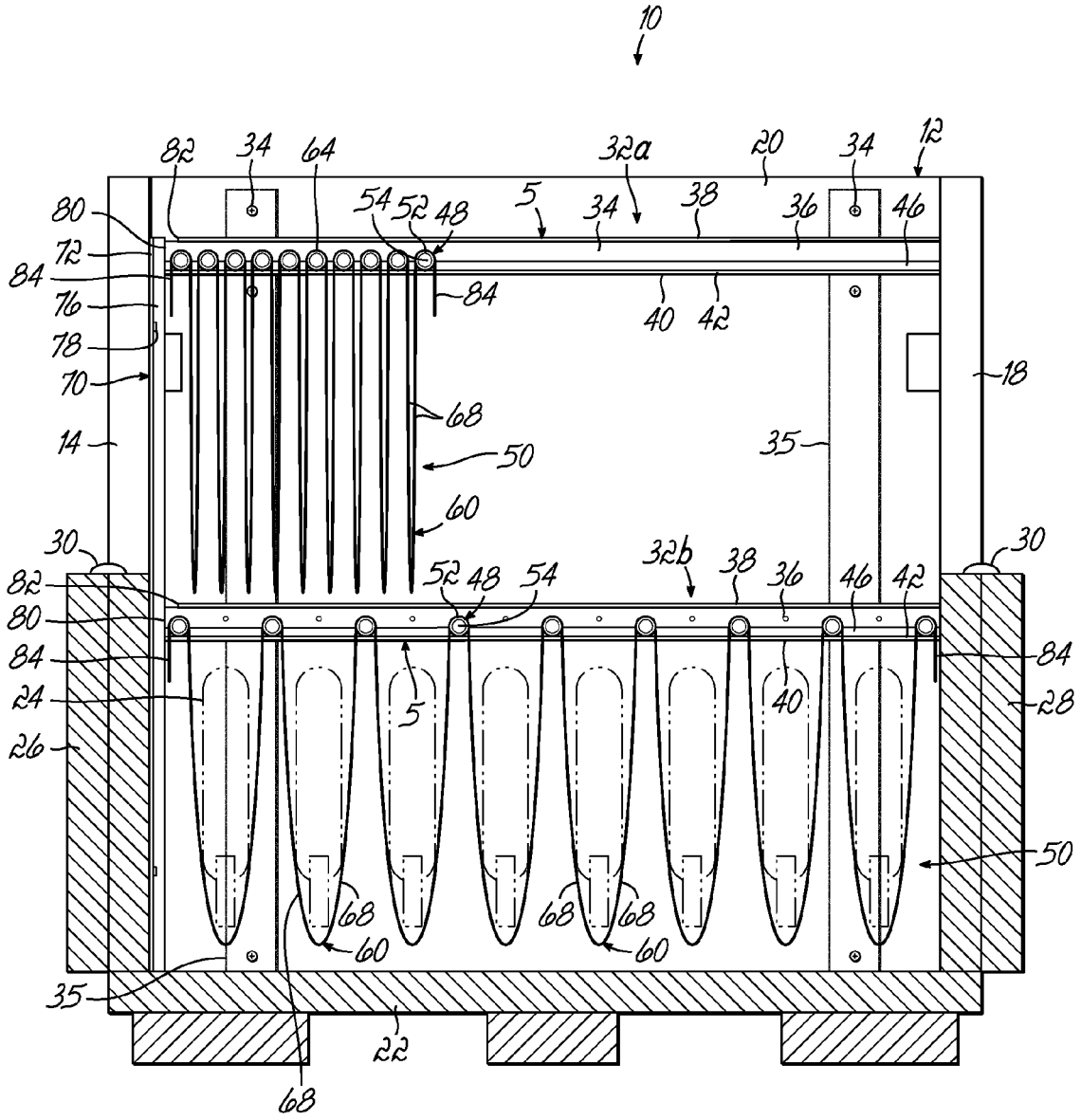
FIG. 8B is a side elevational view of the container of FIG. 8A, showing the upper level of product having been unloaded or the lower level of product having been loaded.
Figure 8C:
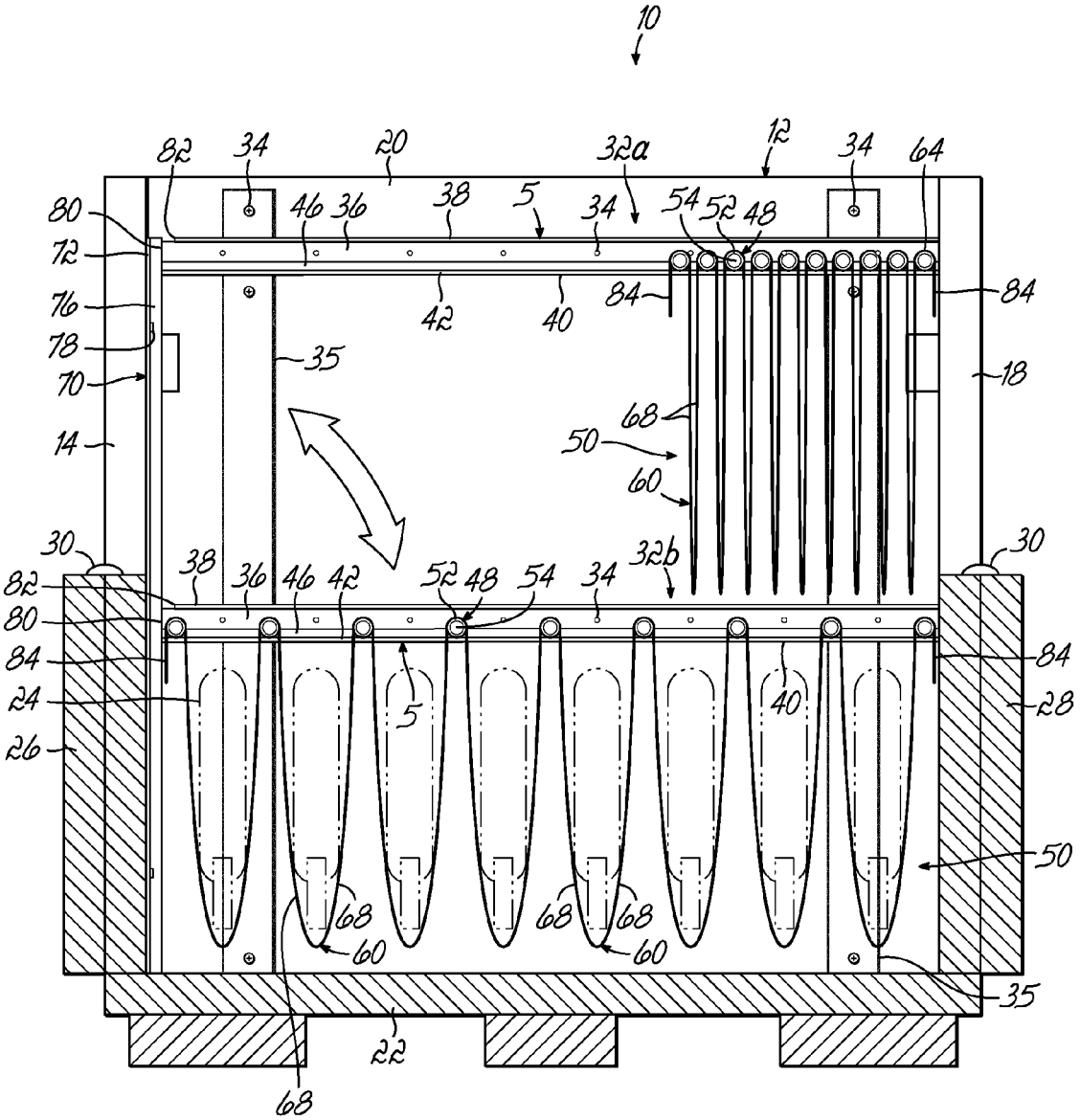
FIG. 8C is a side elevational view of the container of FIG. 8A, showing the lower level of product being loaded or unloaded.

FIGS. 8A, 8B and 8C illustrate the process of unloading product 24 from the container 10 and loading product 24 into the container 10. Each level or layer of support members 48 is adapted to move from back to front inside the interior of the container 10 in a manner described herein.

Operationally, the method of unloading product from the container 10 comprises the following steps. For purposes of this explanation, the operator or person doing the unloading ("the unloader") is located proximate the front of the container. First, as shown in FIG. 8A, products 24 suspended in the pouches 60 of the upper layer or level are lifted out the top of the container 10. One or both of the doors 26, 28 may be open, but need not be open. FIG. 8A illustrates both doors open. Preferably, within any level or layer or row, product 24 suspended in pouches closer to the unloader are removed before products further away from the unloader. The support members 48 supporting empty pouches 60 with the level are then moved or rolled alongside each other at the front of the container. They are now positioned nearest to the unloader, as shown in FIG. 8B. The unloader may then move the entire group of support members 48 and attached empty pouches 60 to a position away from the unloader, as shown in FIG. 8C, to gain access to product 24 in the next lowest level or layer.

The unloader may then remove a second, lower row of product 24 suspended by pouches 60 supported by the second level of support members 48 extending between and supported by the tracks 32*b*. This process continues one level at a time until all products have been removed from all the levels of pouches of the container 10 and all of the support members 48 are pulled forwardly and resting against one another proximate the rear structure 14 of the container 10. As shown in FIG. 8C, to remove the last or lowermost row of product, the unloader need only reach a limited distance over the container or into the container, especially if the front door 26 is open.

Operationally, the method of loading product into the container 10 comprises the following steps. For purposes of this explanation, the operator or person doing the loading ("the loader") is located proximate the front of the container. First, as shown in FIG. 8C, products 24 are inserted through the top of the container 10 into the pouches 60 of the lowest level of dunnage so they are suspended by such dunnage. One or both of the doors 26, 28 may be open, but need not be open. FIGS. 8A, 8B and 8C illustrate front and rear doors 26, 28 open, but one or both may be closed for either loading or unloading. Preferably, within any level or layer, the loader inserts product 24 inside pouches 60 close to him/her and slides them toward the rear of the container before loading additional product 24 inside the empty pouches closer to him/her. The support members 48 supporting full or loaded pouches 60 with the level are then moved rearwardly so that they are positioned away from the loader until the entire row of pouches is full (see FIG. 8C). The loader may then move the entire group of support members 48 and attached empty pouches 60 of the next highest level or layer to a position close to the loader as shown in FIG. 8B to load them with product 24.

The loader may then insert a second row of product 24 suspended by pouches 60 supported by the upper level of support members 48 extending between and supported by the tracks 32*a*. This process may continue one level at a time until all of the pouches of all the levels of the container 10 are suspending product 24. As shown in FIGS. 8A, 8B and 8C, to load product into pouches of the lowermost level, the loader need only reach a limited distance over the container or into the container, especially if one or both of the doors 26, 28 is open.

FIGS. 9-12 illustrate an alternative embodiment of container 10*a*. Container 10*a* is identical to container 10, except the dunnage and support members supporting the dunnage. For simplicity, like parts have the same numbers. The container 10*a* comprises a body 12 having a front 14, a side 16 (partially broken away), a rear 18 and another side 20, all extending upwardly from a base or bottom 22. For purposes of this document, any of the structures 14, 16, 18 or 20 may be considered side structures or sides or walls or wall structures. They are not intended to be limited to the solid configuration illustrated in the drawings.

Figure 9:
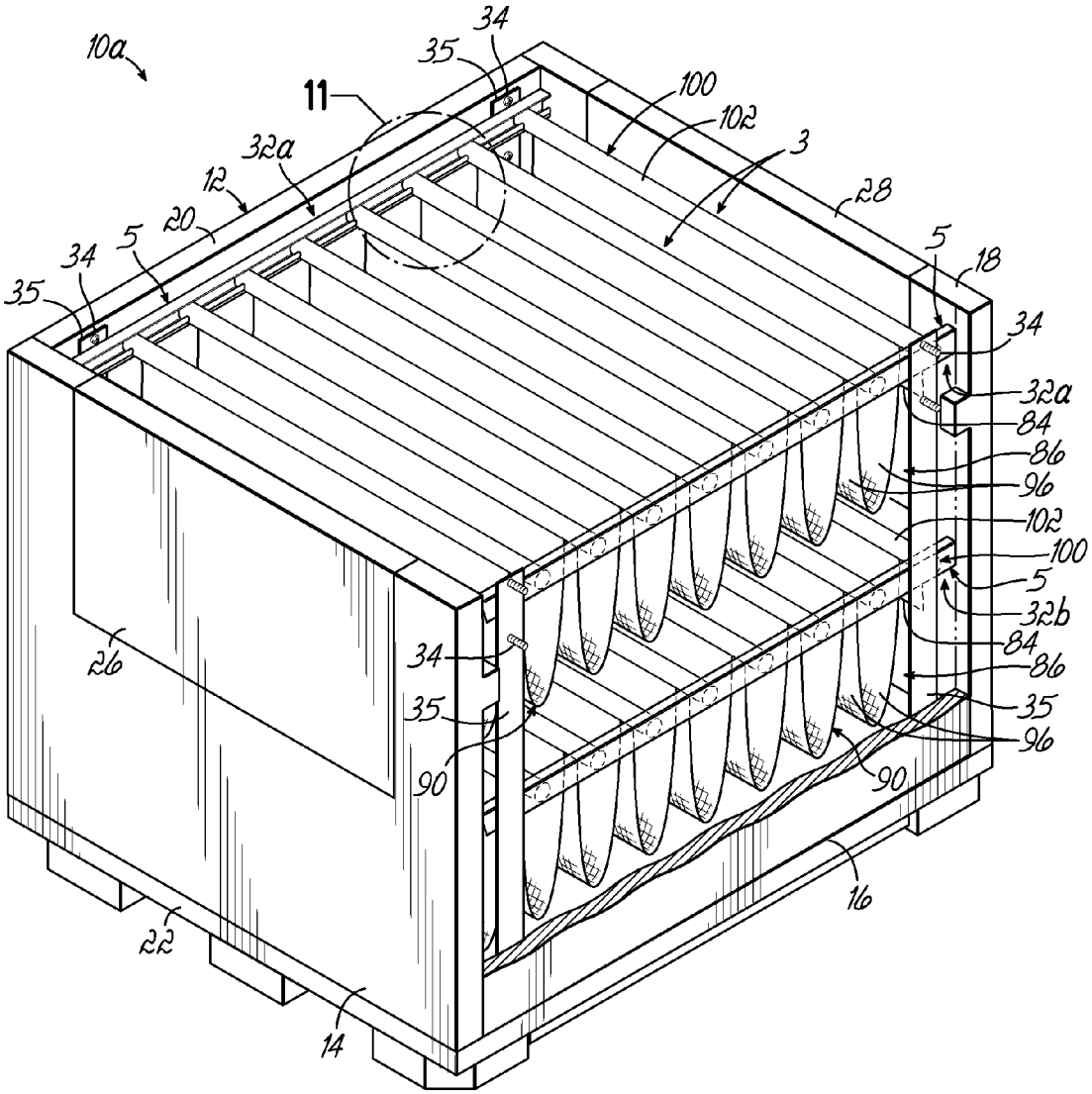
FIG. 9 is a perspective view of a portion of an alternative embodiment of a reusable and returnable container having two levels or layers of track assemblies, support members and associated dunnage in the form of pouches like the container of FIG. 1.

As shown in FIG. 9, front wall or side structure 14 and the rear wall or side structure 18 of container 10*a* each has a drop down door 26, 28, respectively. Each door 26, 28 is hinged to the remainder of the wall or side structure 14, 18, respectively, using hinges, as with the doors 26, 28 of container 10 (see FIGS. 8A and 8B).

As shown in FIGS. 9-12, the container 10*a* further comprises a plurality of track assemblies 32*a*, 32*b* arranged in pairs. The track assemblies 32*a*, 32*b* are welded or otherwise secured to braces 35 which are secured to the body 12 and, more particularly, to opposed sides or side structures 16, 20 of the body 12 via fasteners 34, as best shown in FIG. 2. However, the track assemblies 32*a*, 32*b* may be secured directly to the container body 12 in any known manner without the use of braces. In either case, the container body 12 supports the track assemblies 32*a*, 32*b*, either directly or indirectly. Although two braces 35 are shown per side, any number of braces may be used of any desired size and may be secured to any number of track assemblies and secured to the container body in any embodiment shown or described herein.

FIG. 9 shows container 10*a* having two levels or vertically spaced layers of track assemblies 32*a*, 32*b*. However, this document is not intended to limit the number of levels or layers of track assemblies of any of the embodiments shown or described herein. An upper pair of track assemblies 32*a* is secured to braces 35 secured to opposed sides or side structures 16, 20 of the body 12 at the same vertical level or height inside the container 10*a*. Similarly, a lower pair of track assemblies 32*b* is secured to braces 35 secured to opposed sides or side structures 16, 20 of the body 12 at the same vertical level or height inside the container 10*a* below upper track assemblies 32*a*.

Figure 10:
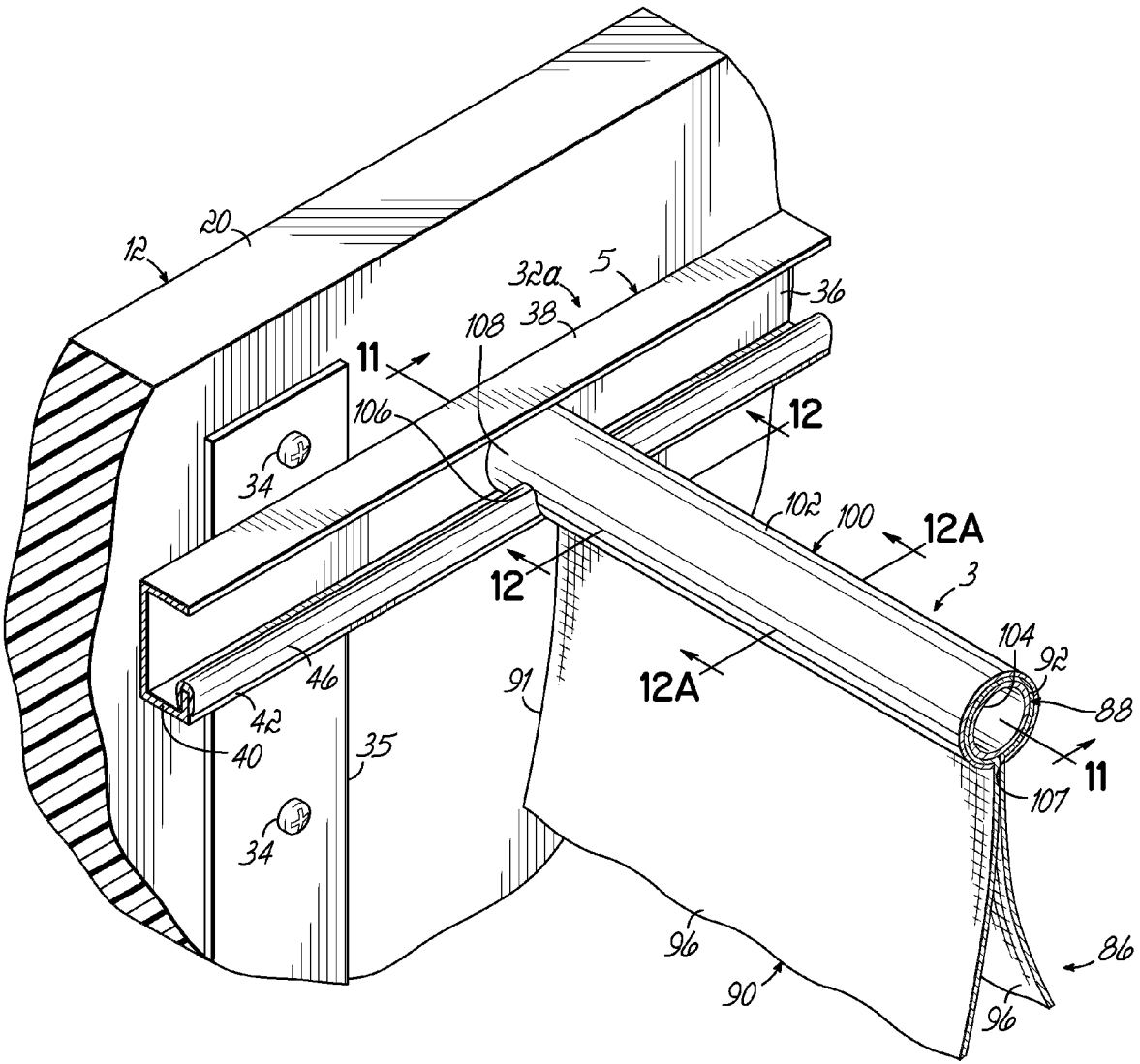
FIG. 10 is a perspective view of the encircled area 10 of FIG. 9.
Figure 11:
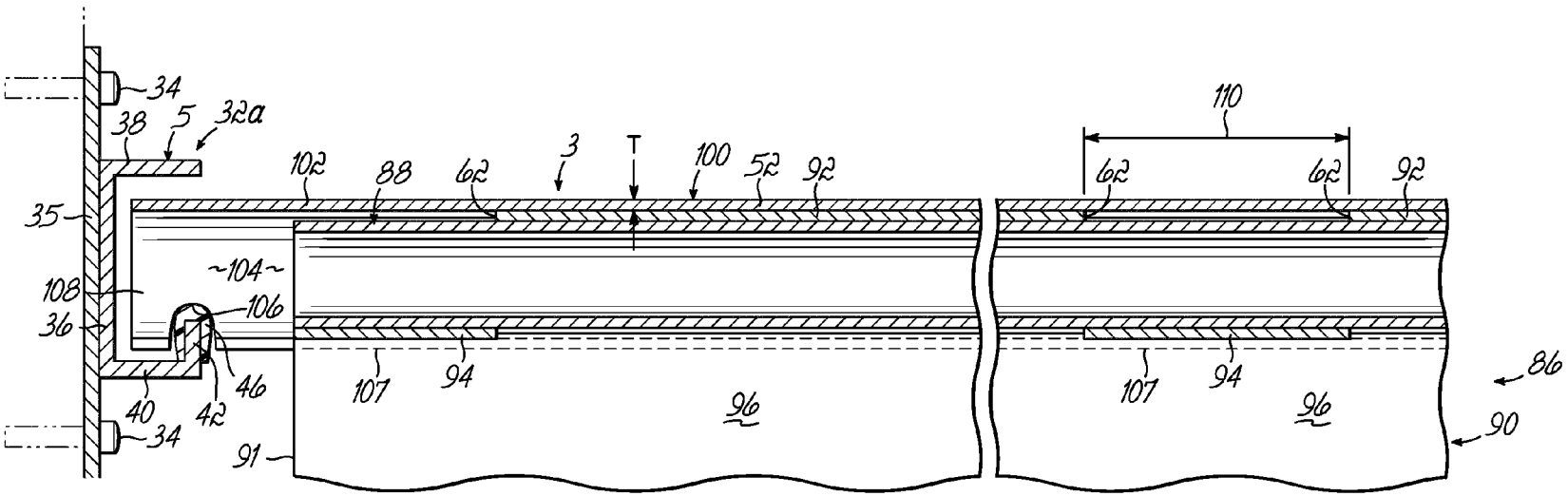
FIG. 11 is a cross-sectional view taken along the line 11-11 of FIG. 10.
Figure 11A:
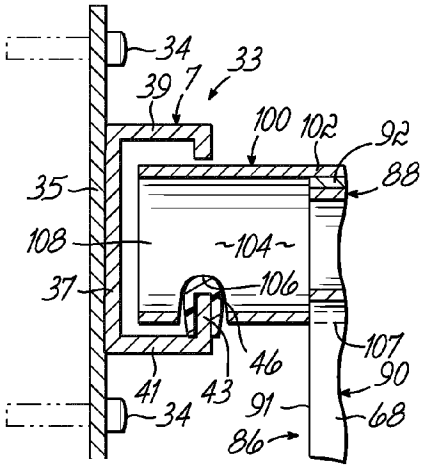
FIG. 11A is a view like FIG. 11 showing a track of a slightly different configuration.

As shown in FIGS. 9-11, each track assembly 32*a*, 32*b* is identical to track assemblies 32*a*, 32*b* shown in FIGS. 1-3. Alternatively, container 10*a* may be fully or partially equipped with track assemblies 33, as shown in FIG. 11A and described herein. In any of the embodiments described herein or illustrated, any of the tracks, track assemblies or containers may omit the track sliders 46.

Figure 12A:
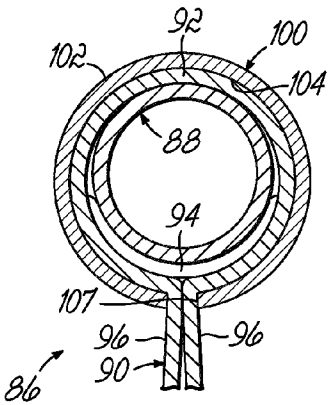
FIG. 12A is a cross-sectional view taken along the line 12A-12A of FIG. 10.
Figure 12:
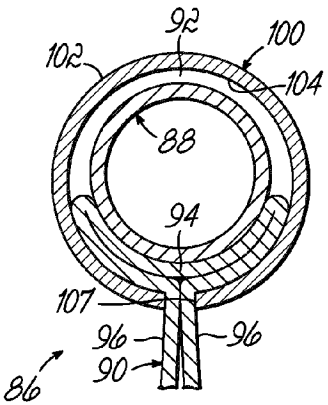
FIG. 12 is a cross-sectional view taken along the line 12-12 of FIG. 10.

FIGS. 9-12 illustrate a dunnage system 86 which is not intended to be limited to any particular container and may be used in any container or embodiment shown or described herein, including a rack as shown in FIG. 15. As best shown in FIG. 9, the dunnage system 86 comprises multiple levels or layers of slidable support assemblies 3 and associated dunnage in the form of pouches 90. Each level or layer comprises a plurality of movable or slidable support assemblies 3 supporting dunnage and extending between a pair of track assemblies. As best shown in FIGS. 11, 12 and 12A, each movable support assembly 3 includes an inner tubular member 88 and an outer tubular support member 100 with dunnage material therebetween. Each of the inner tubular members 88 has a length less than the width of the container and does not contact the tracks or track assemblies of the container 10*a*. The inner tubular members 88 are not notched and may be made from plastic, aluminum or any other metal or material.

According to one aspect of the invention, each level or layer inside the container comprises a single piece of dunnage material used to create pouches 90. However, multiple pieces of material may be used in any one or more levels or layers of dunnage. The material may be a textile material, such as polyester. However, this document is not intended to limit the material of the dunnage/pouches.

As best shown in FIG. 11, at the location of each of the movable support assemblies 3, the dunnage material has a pair of spaced cuts 62 which enable one of the inner tubular members 88 to be threaded through the dunnage material. In addition, a single cut 62 is made in the dunnage material a short distance (about an inch or so) away from each of its outer edges 91 which enables the dunnage material to be tucked underneath the inner tubular member 88 at each end, as shown in FIG. 12. The inner tubular member 88 is then woven through the four slots 62 in the piece of dunnage material so that the dunnage material resides underneath the inner tubular member 88 at each end of the inner tubular member 88 (see FIG. 12) and along one section 110 proximate the middle of the inner tubular member 88. As shown in FIG. 11, the result of such a process of securing the dunnage material to one of the inner tubular members 88 is that portions 92 of the dunnage material reside above the inner tubular member 88, and other portions 94 of the dunnage material reside below the inner tubular member 88. The dunnage material is thereby secured to the inner tubular member 88 without any material being removed from the dunnage material and without the need for any sewing or bonding or welding of the dunnage material. Two sides 96 of the piece of dunnage material extend downwardly from each of the inner tubular members 88 and form sides of the dunnage pouches 90. Another advantage of this dunnage system is that the dunnage material does not rotate around the inner tubular members 88 when parts are loaded into pouches 90.

The dunnage system 86 further comprises a plurality of outer tubular support members 100 at each level or layer. Each outer tubular support member 100 is a unitary member and extends between a pair of track assemblies 32*a*, 32*b* at the same level or height. The track assemblies 32*a*, 32*b* (or 33) support the weight of the support members 100, inner tubular members 88 and associated dunnage pouches 90. FIGS. 10 and 11 illustrate an outer portion of one of the support members 100. Outer support members 100 may be made of metal or plastic, such as polyvinylchloride, known as PVC. Each tubular support member 100 has a wall 102 of a thickness "T" and a hollow interior 104 inside which resides the tubular member 88 and portions of dunnage 90. As shown in FIG. 10, each tubular support member 100 has at each end a notch 106 located in an end portion 108 (only one being shown). As shown in FIG. 11, each tubular support member 100 has a groove 107 extending the length of the support member 100. As shown in FIG. 10, groove 107 cuts through the tubular support member 100 and enables the dunnage material attached to inner tubular member 88 to pass through the outer tubular support member 100 and hang downwardly from the inner tubular members 88. As best shown in FIG. 11, each inner support member 88 is located inside the interior of one of the outer tubular support members 100. The notch 106 at each end of each outer tubular support member 100 rests on top of one of the track sliders 46 (or tracks 5 or 7 as shown in FIG. 2A or 3A) and slides thereon. The notch 106 at each end of each outer tubular support member 100 is sized to reside on and engage one of the track sliders 46 or tracks 5, 7. See FIGS. 11 and 11A. A portion of the end portion 108 of each tubular support member 100 resides inside the interior of one of the tracks 5, 7 and moves therein upon movement of the tubular support member 100.

Figure 13:
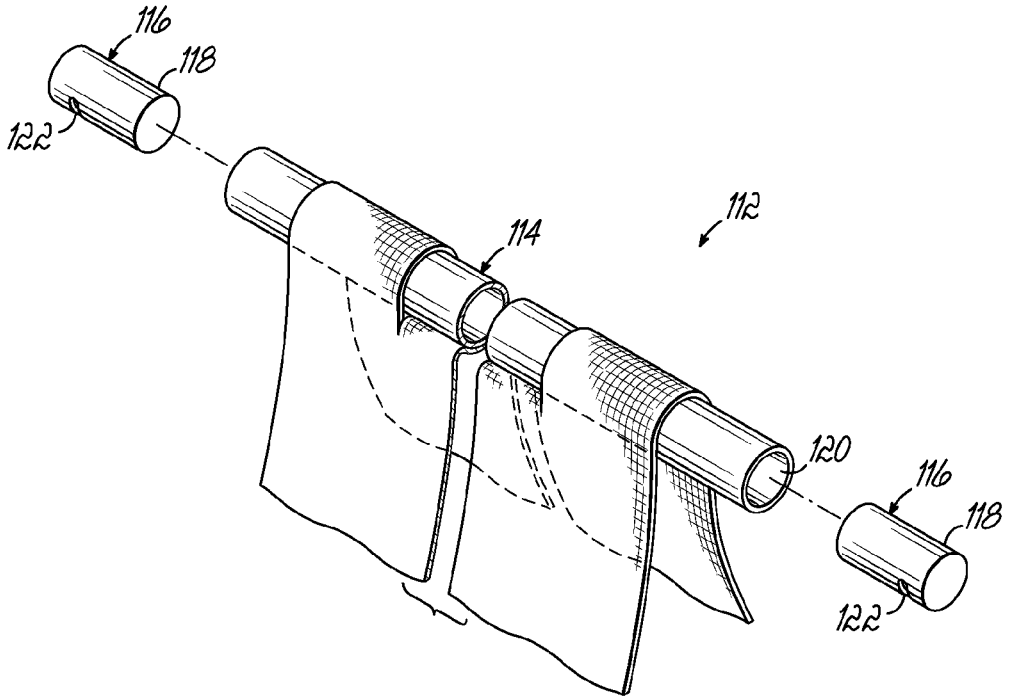
FIG. 13 is a partially disassembled perspective view of an alternative version of support member.
Figure 14:
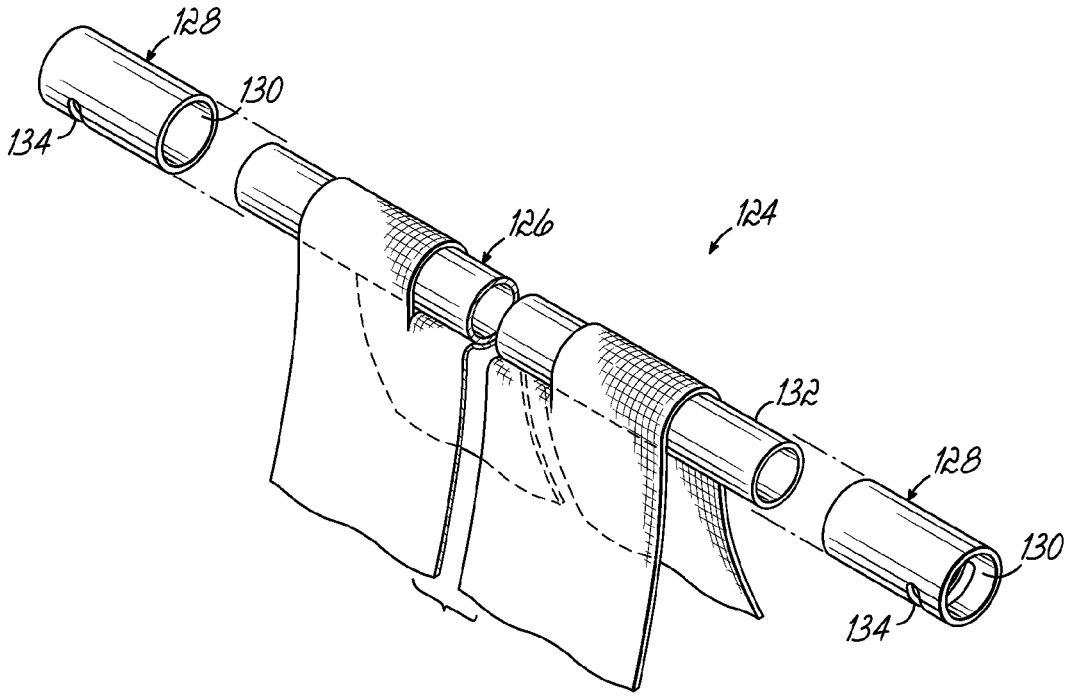
FIG. 14 is a partially disassembled perspective view of another version of support member.

FIGS. 13 and 14 illustrate alternatives to the tubular support members 48, best shown in FIG. 3. Rather than being a unitary member, the support member supporting the dunnage pouches (and parts if loaded) may comprise multiple members. FIG. 13 shows one such possibility comprising a support member 112 having a tubular middle section 114 and two opposed end sections 116. Each end section 116 has an outer diameter 118 slightly less than the inner diameter 120 of the middle section 114 so that the end sections 116 may fit inside the middle section 114. Each of the end sections 116 has a notch 122 sized to slide along one of the tracks or track sliders as described herein.

FIG. 14 shows another possibility comprising a support member 124 having a tubular middle section 126 and two opposed end sections 128. Each end section 128 has an inner diameter 130 slightly greater than the outer diameter 132 of the middle section 126 so that the end sections 128 may fit over the middle section 126. Each of the end sections 128 has a notch 134 sized to slide along one of the tracks or track sliders as described herein.

FIG. 15 illustrates a reusable and returnable container 10*c* according to another embodiment. This container is known in the art as a rack and is typically made of metal, but may be made of other materials. The reusable and returnable container 10*c*, as shown, comprises a body 140 having four corner posts 136 and a bottom or base 138. Each corner post 136 has a knob 139 at the top of the corner post 136. This enables containers 10*c* to be stacked on top of each other, the knobs 139 fitting inside the hollow corner posts 136 of the other container on top. The body 140 has a front beam 142 and a front member 148 secured to and extending between front corner posts 136 and a rear beam 144 secured to and extending between rear corner posts 136. The container 10*c* further comprises three side members 146 secured to and extending between front and rear corner posts 136 on the same side of the container. The container 10*c* further comprises two braces 35 secured with fasteners 34 to each of the three side members 146 on each side of the container. Of course, this rack-style container may include any number of braces, beams and/or track assemblies. This document is not intended to be limited to any one configuration of metal rack container. For example, although one style of base 138 is shown in FIG. 15, the base may assume other configurations.

Container 10*c* further comprises a plurality of track assemblies 32*a*, 32*b*, 32*c* arranged in pairs. The track assemblies 32*a*, 32*b* and 32*c* are secured to braces 35 which are secured to and supported by opposed side members 148 of the body 140. However, the track assemblies 32*a*, 32*b* and 32*c* may be secured in any known manner, such as welding to any number of members of the container body 140. Thus, the track assemblies 32*a*, 32*b* and 32*c* may be supported by and secured to the container body 140.

FIG. 15 shows container 10*c* having three levels or vertically spaced layers of tubular support members 48 and associated dunnage supported by track assemblies 32*a*, 32*b* and 32*c*. However, this document is not intended to limit the number of levels or layers of support members or dunnage of this or any of the containers shown or described herein.

Figure 16:
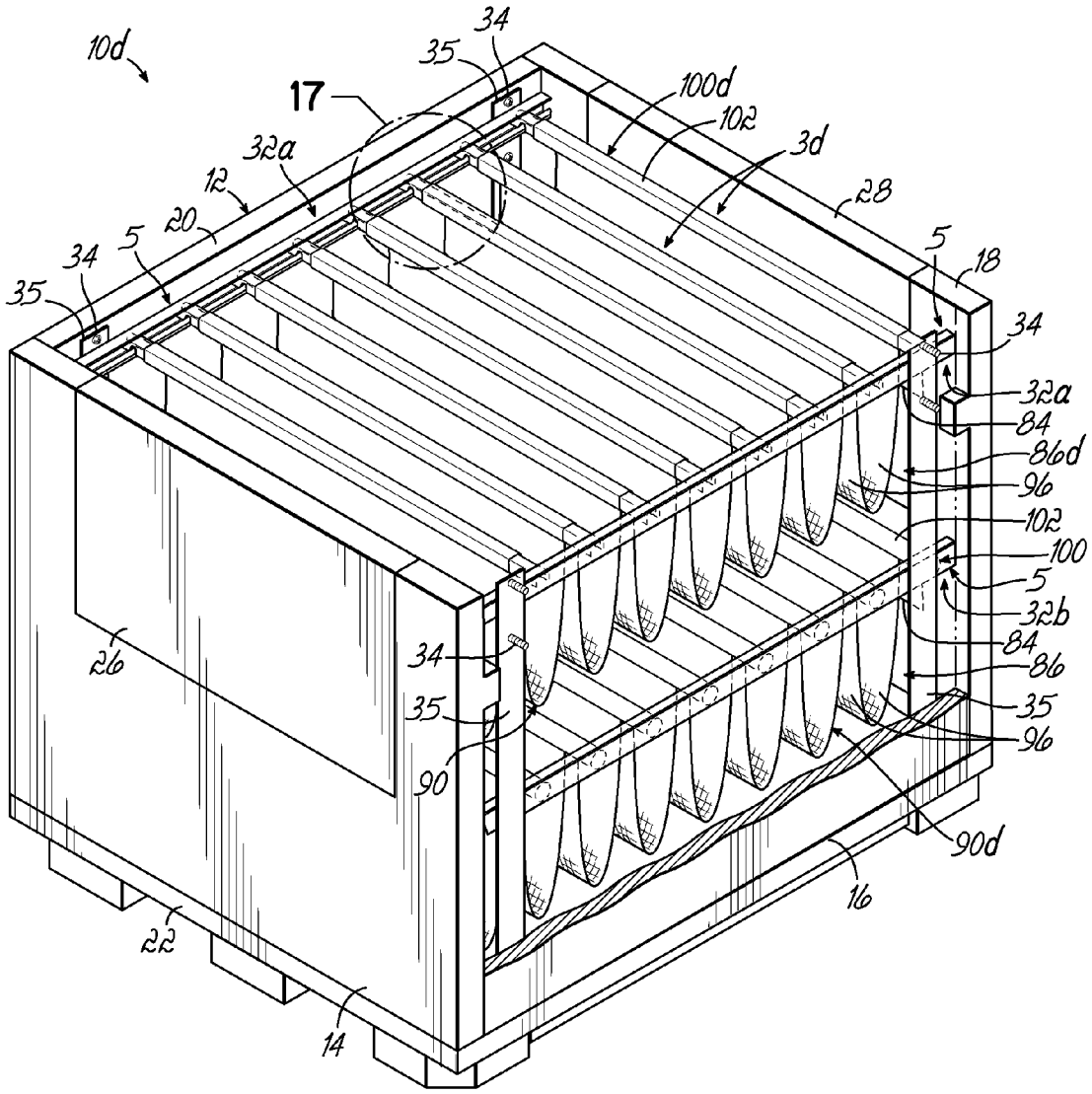
FIG. 16 is a perspective view of a portion of an alternative embodiment of a reusable and returnable container having two levels or layers of track assemblies, support assemblies and associated dunnage in the form of pouches.

FIG. 16 illustrates an alternative embodiment of container 10*d*. Container 10*d* is identical to container 10, except the dunnage 90*d* and support assemblies 3*d* supporting the dunnage 90*d*. For simplicity, like parts have the same numbers. The container 10*d* comprises a body 12 having a front 14, a side 16 (partially broken away), a rear 18 and another side 20, all extending upwardly from a base or bottom 22. For purposes of this document, any of the structures 14, 16, 18 or 20 may be considered side structures or sides or walls or wall structures. They are not intended to be limited to the solid configuration illustrated in the drawings.

As shown in FIG. 16, front wall or side structure 14 and/or the rear wall or side structure 18 of container 10*a* may have a drop down door 26, 28, respectively. Each door 26, 28 may be hinged to the remainder of the wall or side structure 14, 18, respectively, using hinges, as with the doors 26, 28 of container 10 (see FIGS. 8A and 8B).

As shown in FIG. 16, the container 10*d* further comprises a plurality of track assemblies 32*a*, 32*b* arranged in pairs. The track assemblies 32*a*, 32*b* may be welded or otherwise secured to braces 35 which are secured to the body 12 and, more particularly, to opposed sides or side structures 16, 20 of the body 12 via fasteners 34, as best shown in FIG. 2. However, the track assemblies 32*a*, 32*b* may be secured directly to the container body 12 in any known manner without the use of braces. In either case, the container body 12 supports the track assemblies 32*a*, 32*b*, either directly or indirectly. Although two braces 35 are shown per side, any number of braces may be used of any desired size and may be secured to any number of track assemblies and secured to the container body in any embodiment shown or described herein.

FIG. 16 shows container 10*d* having two levels or vertically spaced layers of track assemblies 32*a*, 32*b*. However, this document is not intended to limit the number of levels or layers of track assemblies of any of the embodiments shown or described herein. An upper pair of track assemblies 32*a* may be secured to braces 35 secured to opposed sides or side structures 16, 20 of the body 12 at the same vertical level or height inside the container 10*d*. Similarly, a lower pair of track assemblies 32*b* is secured to braces 35 secured to opposed sides or side structures 16, 20 of the body 12 at the same vertical level or height inside the container 10*d* below upper track assemblies 32*a*.

As shown in FIGS. 16-19A, each track assembly 32*a*, 32*b* is identical to track assemblies 32*a*, 32*b* shown in FIGS. 1-3. Alternatively, container 10*d* may be fully or partially equipped with track assemblies 33, as shown in FIG. 18A and described herein. In any of the embodiments described herein or illustrated, any of the tracks, track assemblies or containers may omit the track sliders 46.

FIGS. 16-19A illustrate a dunnage system 86*d* which is not intended to be limited to any particular container and may be used in any container or rack shown or described herein, including a rack as shown in FIG. 15. As best shown in FIG. 16, the dunnage system 86*d* comprises multiple levels or layers of slidable support assemblies 3*d* and associated dunnage in the form of pouches 90*d*. Each level or layer comprises a plurality of movable or slidable support assemblies 3*d* supporting dunnage and extending between a pair of track assemblies.

As best shown in FIGS. 17, 18, 18A and 19, each movable support assembly 3*d* includes an inner member 88*d* and an outer support member 100*d* with dunnage material surrounding the outer member 100*d*. In the embodiment shown in FIGS. 16-19, the inner member 88*d* is a solid rod made of metal, but may be other shapes or configurations and/or made of any desired material.

Figure 17:
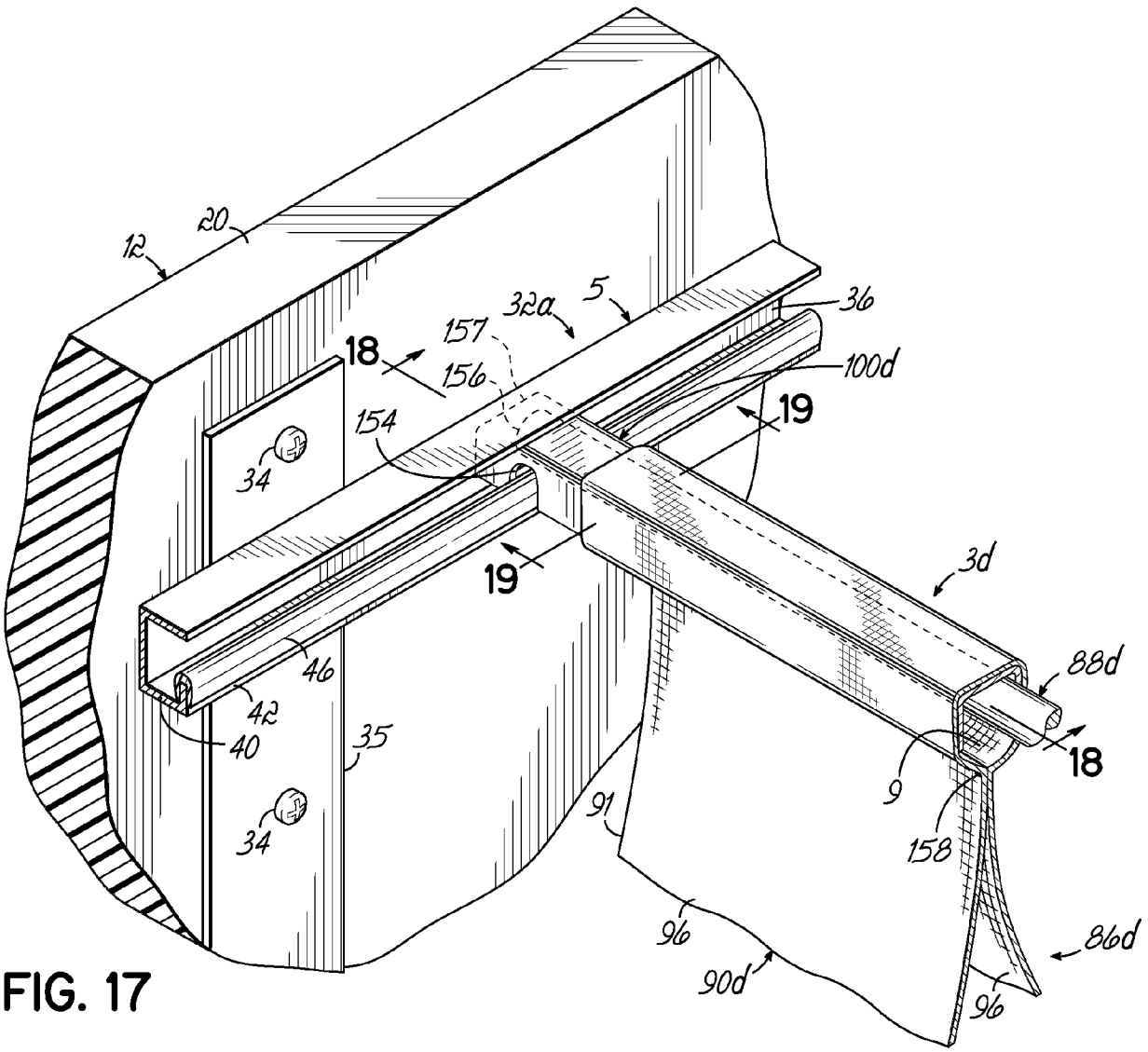
FIG. 17 is a perspective view of the encircled area 17 of FIG. 16.

In the embodiments shown in FIGS. 16-19A, the outer member 100*d* is made of plastic, preferably polyvinylchloride ("PVC") but may be made of any desired material. As best illustrated in FIG. 19, the outer member 100*d* has an inverted U-shape including a top portion 151 and side portions 152 extending downwardly from the top portion 151. As best shown in FIGS. 17 and 18, each outer member 100*d* has a notch 154 in each side portion 152, the notches 154 being located in an end portion 157 of the outer member 100*d* (only one being shown). The notches 154 at each end of each outer member 100*d* rest on top of one of the track sliders 46 and slide thereon. In the absence of track sliders 46, the notches 154 rest on tracks 5 or 7 as shown in FIG. 2A or 3A and slide thereon. An end portion 156 of each inner member 88*d* and an end portion 157 of each outer member 100*d* reside inside the interior of one of the tracks 5, 7 and move therein upon movement of the support assembly 3*d*.

Each of the inner members 88*d* has a length slightly less than the width of the container and contacts the tracks or track assemblies of the container 10*d* while sliding thereon. Each of the inner members 88*d* is sized to reside on and engage one of the track sliders 46 or tracks 5, 7, as shown in FIGS. 18 and 18A. The inner members 88*d* are not notched and may be made from plastic, aluminum or any other metal or material. Each inner member 88*d* of each support assembly 3*d* is held in place and stopped from falling inside the container by being surrounded by outer member 100*d*, as best shown in FIG. 17.

In the container 10*d* shown in FIGS. 16-20, the dunnage system 86*d* made of pouches 90*d* may be secured to each of the support assemblies 3*d* in any manner described or shown in this document. As shown in FIG. 2B, if desired, the dunnage material may be secured to itself via sewing or welding along at least one seam 158, as is known, to create a receiver 9. One of the support member assemblies 3*d* passes through receiver 9. In such a situation, the inner members 88*d* of the support assemblies 3*d* directly contact the track sliders 46 (or tracks 5 or 7) and slide or move along them from front to rear inside the container, as do the outer members 100*d*.

In the embodiment shown in FIG. 19A, the inner member 88*e* is a tubular member having a hollow interior 150, the tubular inner member 88*e* being made of any desired material. In the embodiment shown in FIG. 19A, the outer member 100*d* and dunnage 90*d* are identical to those in the embodiment of FIGS. 16-19.

In any of the embodiments shown or described herein, each level or layer inside the container comprises a single piece of dunnage material used to create pouches 90*d*. However, multiple pieces of material may be used in any one or more levels or layers of dunnage. The material may be a textile material, such as polyester. However, this document is not intended to limit the material of the dunnage/pouches.

While various embodiments of the present invention have been illustrated and described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the applicant's general inventive concept.

What is claimed is:

1. A container for holding product therein during shipment, the container comprising:

a body having a bottom and at least two sides;

tracks supported by the body at different vertical levels;

a plurality of movable support assemblies generally inside the container, each of said support assemblies comprising an inner member and an outer member at least partially surrounding the inner member, the inner and outer members extending between tracks at the same level, the outer member having notches engaged with and slidable along the tracks; and dunnage supported by the support assemblies wherein said dunnage surrounds the outer members of the support assemblies.

2. The container of claim 1 wherein said dunnage comprises pouches.

3. The container of claim 1 wherein each of the tracks is generally C-shaped in cross-section.

4. The container of claim 3 wherein the outer member of the support assembly has an inverted U-shape in cross-section.

5. The container of claim 1 wherein the inner member and the outer member of the support assembly are approximately the same length.

6. The container of claim 1 wherein the container has at least three vertical levels of tracks.

7. The container of claim 1 wherein portions of the inner members of at least some of the support assemblies are located inside the tracks.

8. The container of claim 1 wherein the inner members of at least some of the support assemblies are metal rods.

9. The container of claim 1 wherein the outer members of at least some of the support assemblies are plastic.

10. A container for holding product therein during shipment, the container comprising:

a body having a bottom and at least two side structures;

multiple levels of tracks secured to the side structures;

support assemblies extending between and supported by the tracks at the same level, at least some of the support assemblies comprising an inner member and an inverted U-shaped outer member at least partially surrounding the inner member, the outer member having notches at opposed ends thereof, said notches of the outer member and said inner members contacting and being slidable along tracks at the same level; and dunnage supported by the support assemblies wherein said dunnage surrounds the outer members of the support assemblies.

11. The container of claim 10 wherein the dunnage comprises pouches.

12. The container of claim 10 wherein said support assemblies are located in receivers of said dunnage.

13. The container of claim 10 wherein each of the tracks is generally C-shaped.

14. The container of claim 10 wherein each of the outer members of the support assemblies is made of plastic.

15. The container of claim 10 wherein the container has at least three vertical levels of track assemblies.

16. A container for holding product therein during shipment, the container comprising:

a body having a bottom and at least two side structures;

tracks supported by the side structures at different vertically spaced levels;

a plurality of support assemblies extending between opposed tracks at the same vertical level, each of said support assemblies comprising an inner member and an outer member at least partially surrounding the inner member, the outer member having a pair of notches, each of inner and outer members of each of said support assemblies being engaged with and slidable along the tracks; and dunnage hanging from the support assemblies wherein said dunnage surrounds the outer members of the support assemblies.

17. The container of claim 16 wherein said dunnage comprises pouches.

18. The container of claim 16 wherein each of the inner members is a rod.

19. The container of claim 16 wherein the outer member of each support assembly has an inverted U-shaped cross-section.

20. The container of claim 18 wherein the container has at least three levels of tracks.

* * * * *